US011819860B2

(12) United States Patent
Kim et al.

(10) Patent No.: US 11,819,860 B2
(45) Date of Patent: Nov. 21, 2023

(54) BELT-TYPE ELECTRIC DUST COLLECTION DEVICE AND AIR CONDITIONER HAVING SAME

(71) Applicant: SAMSUNG ELECTRONICS CO., LTD., Suwon-si (KR)

(72) Inventors: Jingyun Kim, Suwon-si (KR); Kyuho Shin, Suwon-si (KR); Jaeyoul Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 556 days.

(21) Appl. No.: 16/757,973

(22) PCT Filed: Dec. 6, 2018

(86) PCT No.: PCT/KR2018/015404
§ 371 (c)(1),
(2) Date: Apr. 21, 2020

(87) PCT Pub. No.: WO2019/112333
PCT Pub. Date: Jun. 13, 2019

(65) Prior Publication Data

US 2022/0032317 A1 Feb. 3, 2022

(30) Foreign Application Priority Data

Dec. 8, 2017 (KR) ..... 10-2017-0168291

(51) Int. Cl.
*B03C 3/10* (2006.01)
*F24F 8/90* (2021.01)
(Continued)

(52) U.S. Cl.
CPC ..... *B03C 3/10* (2013.01); *B03C 3/743* (2013.01); *B03C 3/86* (2013.01); *F24F 8/00* (2021.01); *F24F 8/194* (2021.01); *F24F 8/90* (2021.01)

(58) Field of Classification Search
CPC combination set(s) only.
See application file for complete search history.

(56) References Cited

U.S. PATENT DOCUMENTS 2,579,440 A * 12/1951 Palmer ..... B03C 3/74 55/354
2,786,575 A * 3/1957 Roberts ..... B03C 3/76 209/127.1

(Continued)

FOREIGN PATENT DOCUMENTS

JP 58-45757 3/1983
JP H07275626 A * 10/1995

(Continued)

OTHER PUBLICATIONS

Korean Office Action dated Jan. 14, 2022 from Korean Application No. 10-2017-0168291.

(Continued)

*Primary Examiner* — Christopher P Jones
*Assistant Examiner* — Sonji Turner
(74) *Attorney, Agent, or Firm* — STAAS & HALSEY LLP

(57) ABSTRACT

A belt-type electric dust collection device capable of automatic cleaning includes a dust collection belt including a plurality of flat parts spaced apart at a predetermined distance, and a plurality of first bent parts and second bent parts formed at both ends of the plurality of flat parts. A plurality of first rollers are provided in a line at the plurality of first bent parts of the dust collection belt, to support and guide the dust collection belt. A plurality of second rollers are pro- (Continued)

vided in a line at the plurality of second bent parts of the dust collection belt. A plurality of electrode plates are provided between the plurality of flat parts of the dust collection belt. A belt cleaning part is provided at one side of the dust collection belt, and a driving part is provided to move the dust collection belt.

14 Claims, 20 Drawing Sheets

(51) Int. Cl.

| | |
|---|---|
| ***F24F 8/192*** | (2021.01) |
| ***B03C 3/74*** | (2006.01) |
| ***B03C 3/86*** | (2006.01) |
| ***F24F 8/00*** | (2021.01) |

(56) References Cited

U.S. PATENT DOCUMENTS

| | | | | |
|---|---|---|---|---|
| 3,028,714 | A * | 4/1962 | Mayer | B03C 3/10 96/40 |
| 3,375,638 | A * | 4/1968 | Dungler | F24F 8/192 55/351 |
| 3,581,468 | A * | 6/1971 | Gourdine | B03C 3/10 96/40 |
| 4,378,980 | A | 4/1983 | Long | |
| 5,912,423 | A | 6/1999 | Doughty et al. | |
| 9,827,525 | B2 * | 11/2017 | Oh | F24F 8/10 |
| 2010/0291848 | A1 * | 11/2010 | Swoboda | B03C 3/16 454/53 |

FOREIGN PATENT DOCUMENTS

| | | | |
|---|---|---|---|
| JP | 11-290719 | | 10/1999 |
| JP | 2014-100642 | | 6/2014 |
| KR | 2000-0069885 | | 11/2000 |
| KR | 10-0356572 | | 10/2002 |
| KR | 20-0333994 | | 11/2003 |
| KR | 10-2011-0116864 | | 10/2011 |
| KR | 10-1108123 | | 1/2012 |
| KR | 10-1199350 | | 11/2012 |
| KR | 10-1474493 | | 12/2014 |
| KR | 10-2018-0086899 | | 8/2018 |
| TW | 0823284 | A1 * | 2/1998 |

OTHER PUBLICATIONS

International Search Report dated Mar. 14, 2019, in corresponding International Patent Application No. PCT/KR2018/015404.

Written Opinion of the International Searching Authority dated Mar. 14, 2019 , in corresponding International Patent Application No. PCT/KR2018/015404.

* cited by examiner

BELT-TYPE ELECTRIC DUST COLLECTION DEVICE AND AIR CONDITIONER HAVING SAME

CROSS-REFERENCE TO RELATED APPLICATIONS

This application is a U.S. National Stage Application which claims the benefit under 35 U.S.C. § 371 of International Patent Application No. PCT/KR2018/015404 filed on Dec. 6, 2018, which claims foreign priority benefit under 35 U.S.C. § 119 of Korean Patent Application No. 10-2017-0168291 filed on Dec. 8, 2017 in the Korean Intellectual Property Office, the contents of both of which are incorporated herein by reference.

TECHNICAL FIELD

The disclosure relates to an electric dust collection device using an electrostatic force, and more particularly, to an electric dust collection device capable of automatic cleaning and an air conditioner having the same.

BACKGROUND ART

Fine materials such as dust, microorganisms, aerosols, etc. contained in air inside the room may adversely affect human health.

Electric dust collection devices are widely used to remove such fine materials. The electric dust collection device is provided in an air conditioner such as an air purifier, an air con, a humidifier, and the like to remove fine materials contained in the indoor air.

The electric dust collection device includes electrodes and a flow path such that the fine materials are charged and then attached by electrostatic force. Because the electric dust collection device utilizes an electrostatic force, it is effective for removing small sized fine materials, and can minimize the blockage of the flow path, thereby reducing the air flow loss.

An example of the conventional electric dust collection device is illustrated in FIG. 1.

Referring to FIG. 1, an electric dust collection device 1 includes a charging part 3 and a dust collecting part 5 disposed downstream of the charging part 3. The charging part 3 charges contaminants or fine materials contained in the air flowing into the electric dust collection device 1 to the positive (+) or the negative (−) by using the high voltage discharge.

The dust collecting part 5 serves to collect the contaminants charged by the charging part 3. The dust collecting part 5 is formed in a structure in which a plurality of flat high voltage electrodes 6 and a plurality of flat low voltage electrodes 7 are stacked at regular intervals. When a predetermined voltage is applied between the positive electrode (high voltage electrode) 6 and the negative electrode (low voltage electrode) 7 of the dust collecting part 5, an electric field is formed between the positive electrode 6 and the negative electrode 7. For example, when the contaminants contained in air is charged to have positive (+) polarity while the air passes through the charging part 3, the contaminants charged with positive polarity are attached to the negative electrode 7 while passing through the dust collecting part 7, thereby being removed from the air.

However, in such a conventional electric dust collection device 1, as the contaminants are collected, the electrostatic force is weakened by the collected contaminants, so the dust collection performance is lowered.

Therefore, manufactures of the electric dust collection devices are instructing users to manually clean the dust collecting plates of the electric dust collection device periodically.

However, there is a problem that it is inconvenient to manually wash the dust collecting plates to which fine materials are attached. In addition, when the dust collecting plates are washed after the electric dust collection device has been operated for a long time, it is difficult to clean the dust collecting plates because the physical properties of the fine materials are changed due to the high voltage and then fixed to the dust collecting plates.

DISCLOSURE OF INVENTION

Technical Problem

The disclosure has been developed in order to overcome the above drawbacks and other problems associated with the conventional arrangement. An aspect of the disclosure relates a belt type electric dust collection device that does not require manual cleaning and can automatically clean a dust collecting belt to which contaminants are attached.

Technical Solution

According to an aspect of the disclosure, a belt type electric dust collection device may include a dust collecting belt arranged to overlap in a zigzag form, the dust collecting belt including a plurality of flat portions facing parallel to each other and spaced apart by a predetermined distance and a plurality of first bent portions and a plurality of second bent portions formed at both ends of the plurality of flat portions; a plurality of first rollers disposed in a line in the plurality of first bent portions of the dust collecting belt, the plurality of first rollers configured to support and guide the dust collecting belt; a plurality of second rollers disposed in a line in the plurality of second bent portions of the dust collecting belt, the plurality of second rollers configured to support and guide the dust collecting belt; a plurality of electrode plates provided between the plurality of flat portions of the dust collecting belt; a belt cleaning part disposed at one side of the dust collecting belt and configured to remove contaminants from both surfaces of the dust collecting belt; and a drive part provided to drive at least one of the plurality of first rollers so as to move the dust collecting belt.

The dust collecting belt may be formed of one endless belt connected to both ends thereof.

The drive part may include a roller gear coaxially disposed in at least one of the plurality of first rollers; a worm gear meshing with the roller gear; and a drive motor configured to rotate the worm gear.

The drive part may include a pinion gear disposed on a shaft of the drive motor; and a spur gear disposed coaxially with the worm gear and engaged with the pinion gear.

The belt type electric dust collection device may include at least one backup roller disposed at one side of the at least one first roller provided with the roller gear and configured to press the dust collecting belt against the at least one first roller.

The belt cleaning part may be disposed at one side of the plurality of first rollers in a longitudinal direction of the dust collecting belt, and the belt type electric dust collection device may include a plurality of guide rollers configured to guide the dust collecting belt to the belt cleaning part.

The belt type electric dust collection device may include a first winding roller and a second winding roller disposed at both ends of the dust collecting belt and configured to wind and unwind the dust collecting belt.

The drive part may include a roller gear coaxially disposed in at least one of the plurality of first rollers; a first winding gear train and a second winding gear train configured to respectively transmit a rotational force to the first winding roller and the second winding roller; a worm gear meshing with the roller gear, the first winding gear train, and the second winding gear train; and a drive motor configured to rotate the worm gear.

The first regulating roller and the second regulating roller may include an one-way clutch, respectively.

The belt cleaning part may include a first cleaning member configured to remove contaminants attached to one surface of the dust collecting belt; a second cleaning member configured to remove contaminants attached to an opposite surface of the dust collecting belt; and a contaminants container configured to collect the contaminants removed from the dust collecting belt by the first cleaning member and the second cleaning member.

The first cleaning member and the second cleaning member may be disposed to face each other with the dust collecting belt interposing therebetween.

The belt type electric dust collection device according to an embodiment of the disclosure having the above-described structure may be disposed in an air conditioner.

Advantageous Effects

A belt type electric dust collection device according to an embodiment of the disclosure having the above-described structure may automatically remove contaminants attached to a dust collecting belt. Accordingly, the belt type electric dust collection device can maintain an air cleaning capability almost permanently without a user having to periodically clean the electric dust collection device.

In addition, the belt type electric dust collection device according to an embodiment of the disclosure as described above can automatically remove contaminants attached to the dust collecting belt, so that it is not necessary to disassemble a ceiling type air conditioner for cleaning. Therefore, the ceiling type air conditioner using the belt type electric dust collection device according to an embodiment of the disclosure has an advantage of easy maintenance.

BEST MODE FOR CARRYING OUT THE INVENTION

Hereinafter, embodiments of a belt type electric dust collection device according to the disclosure and an air conditioner including the same will be described in detail with reference to the accompanying drawings.

The matters defined herein, such as a detailed construction and elements thereof, are provided to assist in a comprehensive understanding of this description. Thus, it is apparent that embodiments may be carried out without those defined matters. Also, well-known functions or constructions are omitted to provide a clear and concise description of embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the disclosure, a first component may be referred to as a second component, and similarly, a second component may also be referred to as a first component.

The terms used in embodiments of the disclosure may be construed as commonly known to those skilled in the art unless otherwise defined.

Further, the terms 'leading end', 'rear end', 'upper side', 'lower side', 'top end', 'bottom end', etc. used in the disclosure are defined with reference to the drawings. However, the shape and position of each component are not limited by the terms.

Figure 2:
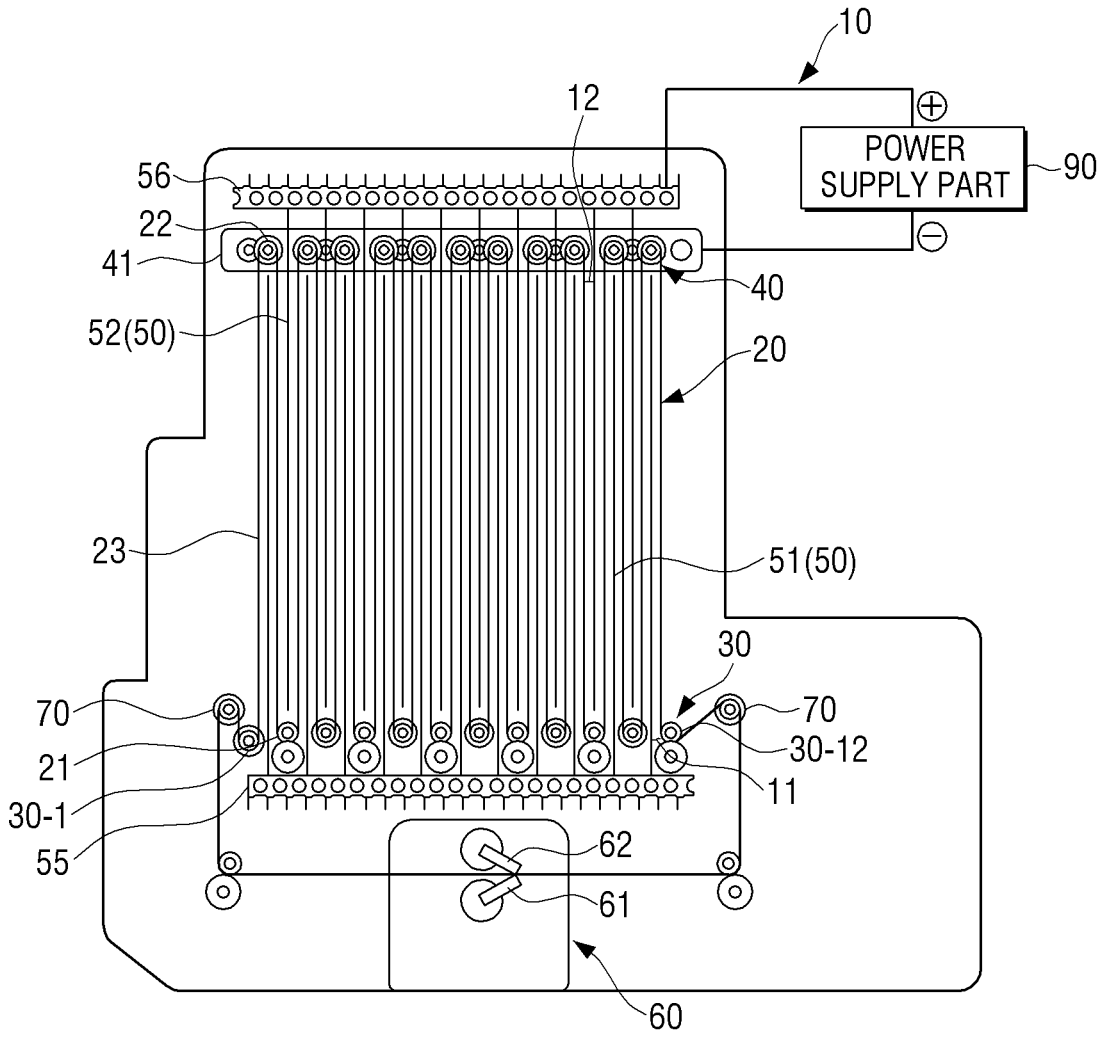
FIG. 2 is a view conceptually illustrating a belt type electric dust collection device according to an embodiment of the disclosure.

FIG. 2 is a view conceptually illustrating a belt type electric dust collection device according to an embodiment of the disclosure.

Referring to FIG. 2, a belt type electric dust collection device 10 according to an embodiment of the disclosure may include a dust collecting belt 20, a plurality of first rollers 30, a plurality of second rollers 40, a plurality of electrode plates 50, a belt cleaning part 70, and a drive part (not illustrated).

The dust collecting belt 20 is formed of an endless belt whose both ends are connected to each other, and is arranged to be overlapped in a zigzag form. Accordingly, the dust collecting belt 20 includes a plurality of flat portions 21 which face each other in parallel and are spaced apart from each other by a predetermined distance and a plurality of first bent portions 22 and second bent portions 23 provided at both ends of the plurality of flat portions 21. The outside air passes between the plurality of flat portions 21.

Figure 1:
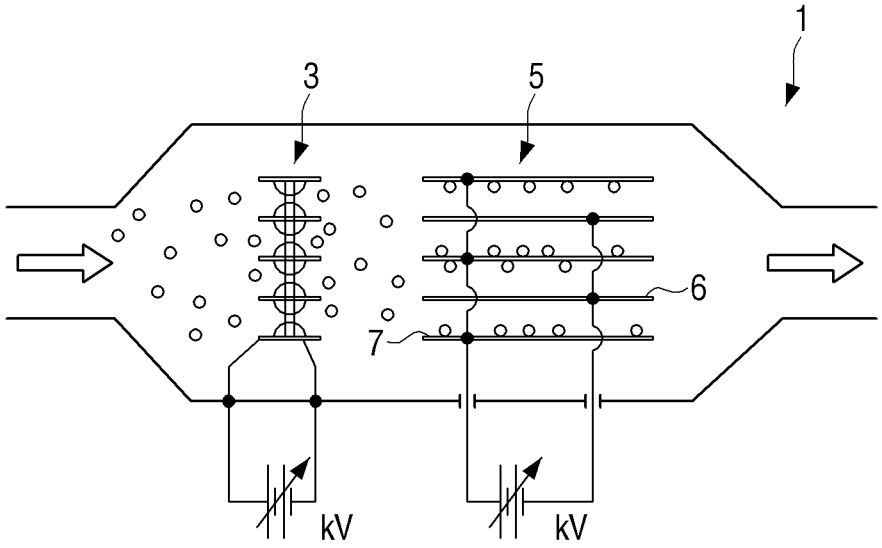
FIG. 1 is a view for explaining a conventional electric dust collection device.

The dust collecting belt 20 is formed such that contaminants charged in the charging part 3 (see FIG. 1) may be attached thereto. Therefore, the dust collecting belt 20 is formed in a long film shape and is formed of a material having conductivity.

The plurality of first rollers 30 and the plurality of second rollers 40 are spaced apart from each other by a predetermined interval and are disposed in parallel with each other. The plurality of first rollers 30 and the plurality of second rollers 40 support the dust collecting belt 20 so that the dust collecting belt 20 maintains an overlapped state in a zigzag form.

Accordingly, the dust collecting belt 20 is provided to sequentially wind the plurality of first rollers 30 and second rollers 40 as illustrated in FIG. 2. Therefore, the plurality of first bent portions 21 in which portions of the dust collecting belt 20 are wound around the plurality of first rollers 30 are formed, and the plurality of second bent portions 22 in which portions of the dust collecting belt 20 are wound around the plurality of second rollers 40 are formed. The portion between the first bent portion 21 and the second bent portion 22 of the dust collecting belt 20 forms a flat portion 23 in which the portion of the dust collecting belt 20 is flat. Accordingly, the plurality of flat portions 23 are formed between the plurality of first bent portions 21 and the plurality of second bent portions 22.

Accordingly, the plurality of first rollers 30 are disposed at one ends of the plurality of flat portions 23, that is, at the plurality of first bent portions 21 of the dust collecting belt 20 to support and guide the dust collecting belt 20 so that the dust collecting belt 20 may be moved. The plurality of first rollers 30 are disposed to be spaced apart at equal intervals.

The plurality of second rollers 40 are disposed at the other ends of the plurality of flat portions 23, that is, at the plurality of second bent portions 22 of the dust collecting belt 20 to support and guide the dust collecting belt 20 so that the dust collecting belt 20 may be moved. The plurality of second rollers 40 are formed to have the same diameter as the plurality of first rollers 30, and are disposed to be spaced apart from each other at the same interval as that between the plurality of first rollers 30. Therefore, the plurality of flat portions 23 of the dust collecting belt 20 are spaced apart by the diameters of the first roller 30 and the second roller 40.

In addition, the plurality of second rollers 40 are provided so as not to face the plurality of first rollers 30 in a direction parallel to the plurality of flat portions 23. Therefore, a plurality of first openings 11 facing the plurality of second rollers 40 are provided between the plurality of first rollers 30. Similarly, a plurality of second openings 12 facing the plurality of first rollers 30 are provided between the plurality of second rollers 40.

At least some of the plurality of first rollers 30 and the plurality of second rollers 40 are formed of a conductive material to allow electricity to flow to the dust collecting belt 20.

A roller electricity conducting member 41 is electrically connected to the plurality of first rollers 30 or the plurality of second rollers 40. Therefore, a voltage may be applied from a power supply part 90 to the dust collecting belt 20 through the roller electricity conducting member 41, the first roller 30, and/or the second roller 40.

The plurality of electrode plates 50 are provided between the plurality of flat portions 23 of the dust collecting belt 20. The plurality of electrode plates 50 may include a first electrode plate 51 and a second electrode plate 52. In detail, the plurality of first electrode plates 51 are disposed through the plurality of first openings 11 of the dust collecting belt 20, and the plurality of second electrode plates 52 are disposed through the plurality of second openings 12. The plurality of first electrode plates 51 and the plurality of second electrode plates 52 are formed in the same manner, but the directions to be inserted between the plurality of flat portions 23 of the dust collecting belt 20 are different.

The plurality of electrode plates 50 are for forming an electric field between the plurality of flat portions 23 of the dust collecting belt 20 so that the charged contaminants are attached to the dust collecting belt 20. A voltage having a polarity opposite to the dust collecting belt 20 is applied to the plurality of electrode plates 50. For example, when a negative voltage or a low voltage is applied to the dust collecting belt 20 as illustrated in FIG. 2, a positive voltage or a high voltage is applied to the plurality of electrode plates 50.

Electrode plate conducting members 55 and 56 are electrically connected to the plurality of electrode plates 50. In detail, the plurality of first electrode plates 51 disposed in the plurality of first openings 11 of the dust collecting belt 20 are electrically connected to a first electrode plate conducting member 55, and the plurality of second electrode plates 52 disposed in the plurality of second openings 12 are electrically connected to a second electrode plate conducting member 56. The same voltage is applied from the power supply part 90 to the first electrode plate conducting member 55 and the second electrode plate conducting member 56.

The belt cleaning part 60 is disposed at one side of the dust collecting belt 20 and is formed to remove contaminants attached to both surfaces of the dust collecting belt 20. For example, the belt cleaning part 60 is spaced apart by a predetermined distance from the plurality of first rollers 30 at one side of the plurality of first rollers 30 in the longitudinal direction of the dust collecting belt 20, that is, in the longitudinal direction of the plurality of electrode plates 50.

On the left side and the right side of the belt cleaning part 60, a plurality of guide rollers 70 configured to guide the dust collecting belt 20 which comes out from plurality of first rollers 30 to the belt cleaning part 60 and to return the dust collecting belt 20 which has passed through the belt cleaning part 60 back to the plurality of first rollers 30 may be disposed.

In the case of the embodiment illustrated in FIG. 2, the plurality of guide rollers 70 which guide the dust collecting belt 20 to the belt cleaning part 60 and return the dust collecting belt 20 coming from the belt cleaning part 60 toward the first rollers 30 are provided on one side of each of the two first rollers 30-1 and 30-12 disposed on the leftmost and rightmost sides of the plurality of first rollers 30.

The drive part (not illustrated) generates a driving force so that the dust collecting belt 20 can be moved by the plurality of first rollers 30 and the plurality of second rollers 40. The drive part is formed to drive at least one first roller 30 among the plurality of first rollers 30.

Hereinafter, the belt type electric dust collection device according to an embodiment of the disclosure will be described in detail with reference to FIGS. 3 to 7.

Figure 3:
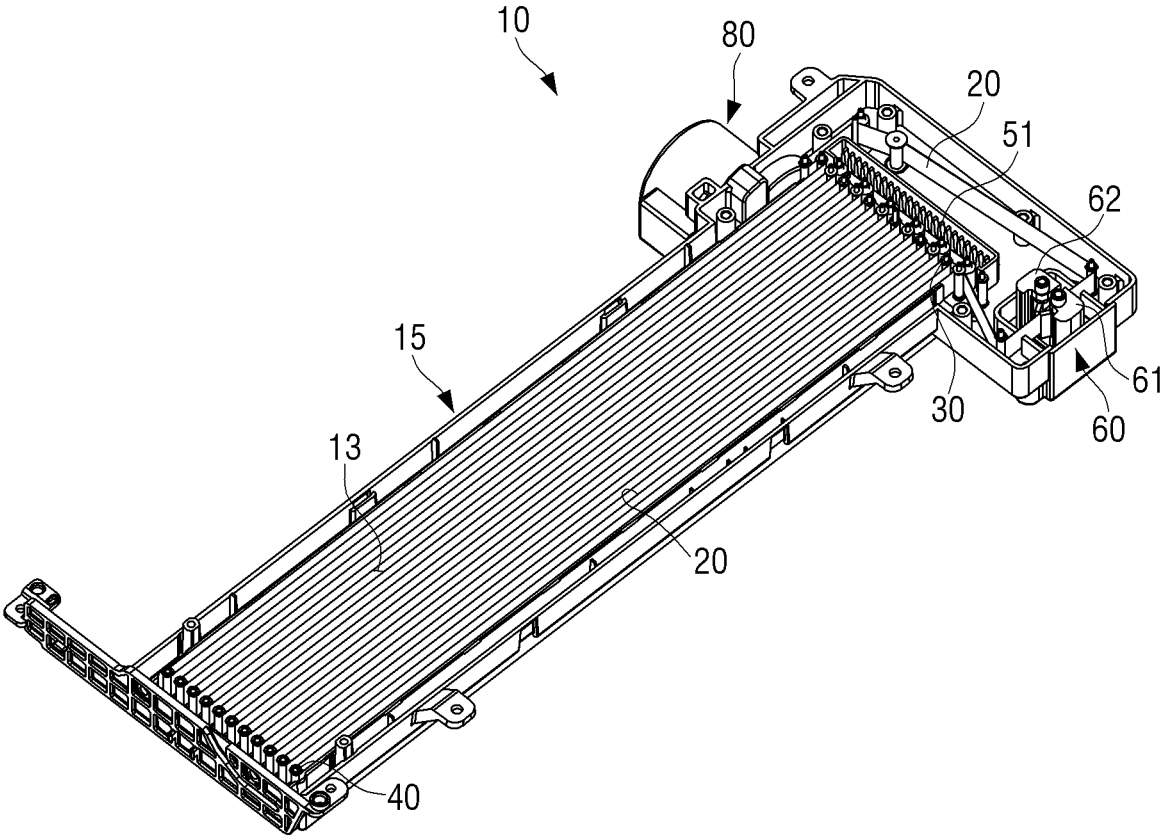
FIG. 3 is a perspective view illustrating a belt type electric dust collection device according to an embodiment of the disclosure.
Figure 4:
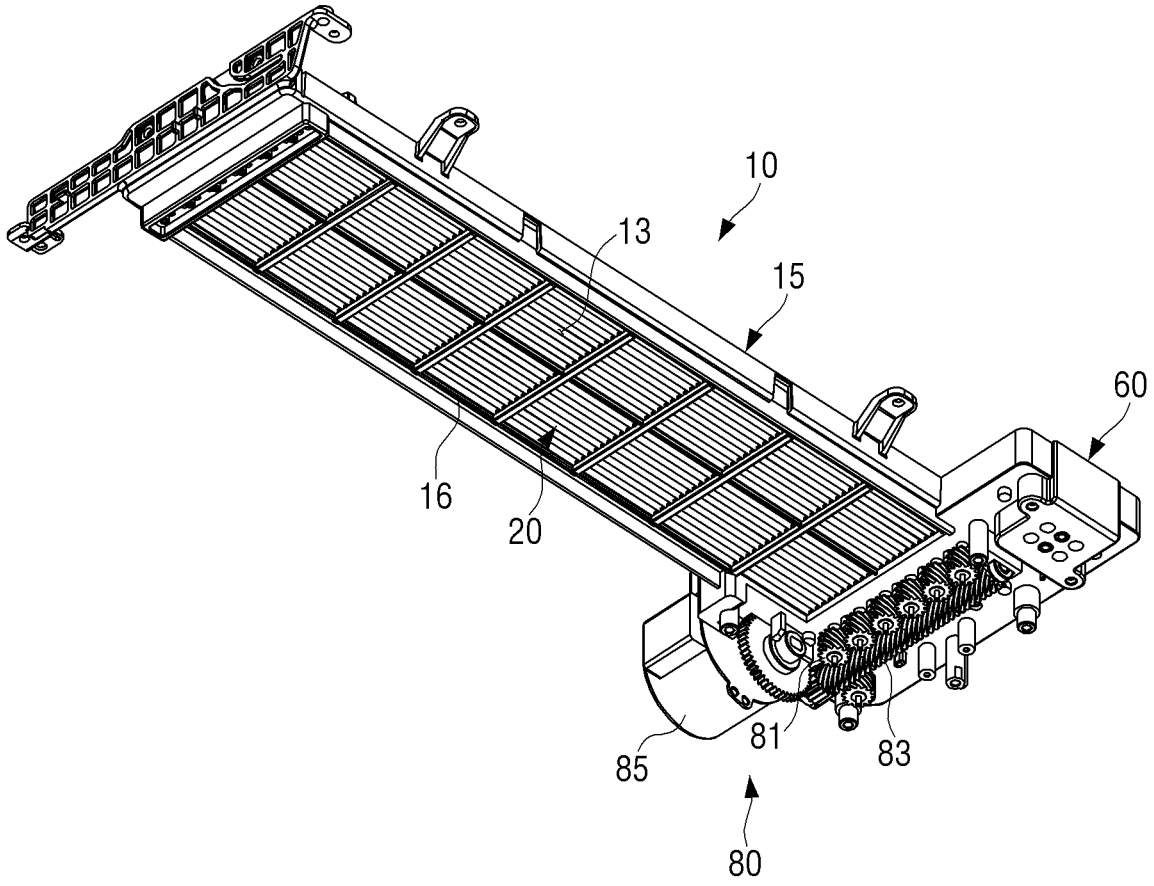
FIG. 4 is a rear perspective view illustrating the belt type electric dust collection device of FIG. 3.
Figure 5:
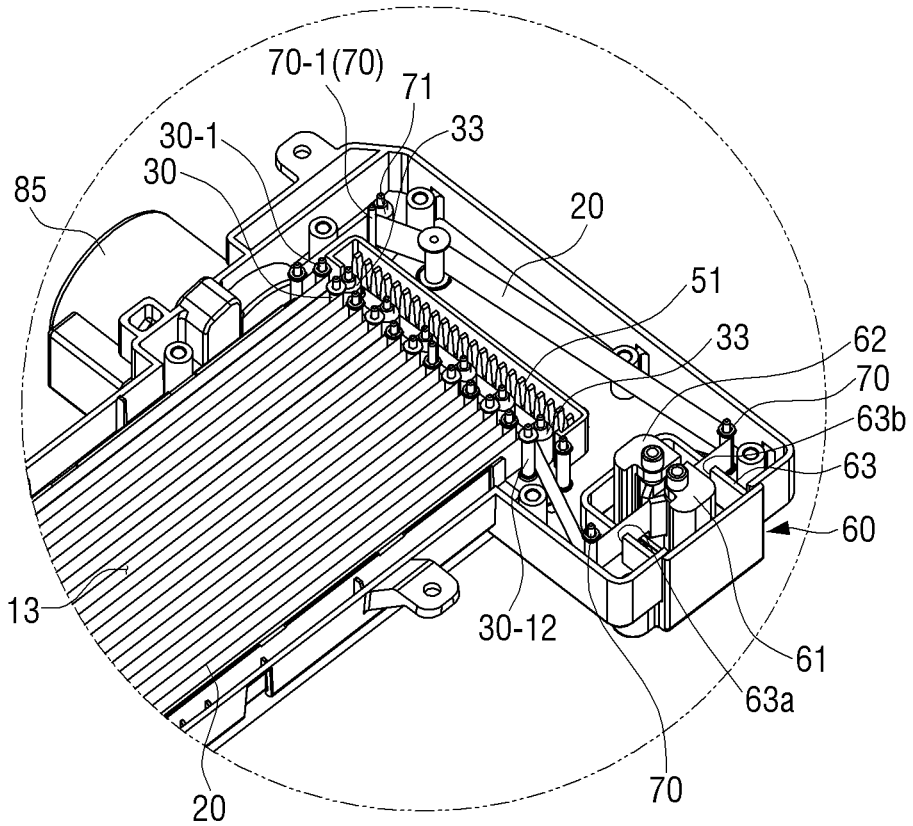
FIG. 5 is a partial perspective view illustrating a portion of the belt type electric dust collection device of FIG. 3.
Figure 6:
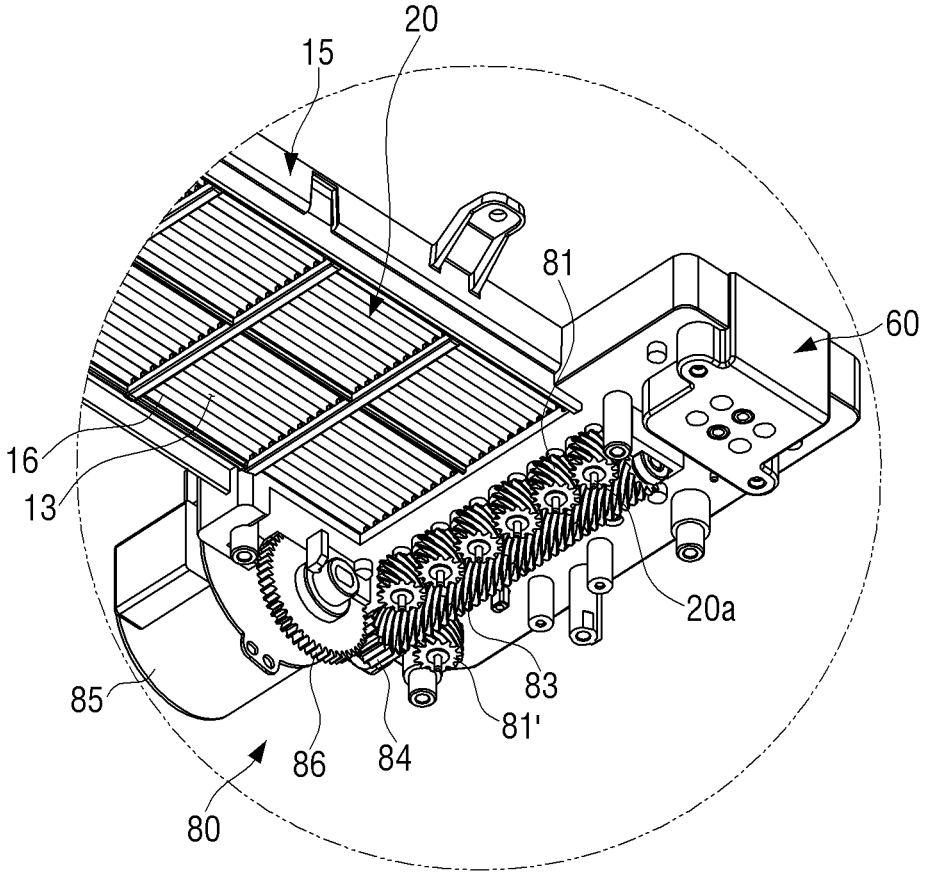
FIG. 6 is a partial rear perspective view illustrating a portion of the belt type electric dust collection device of FIG. 4.
Figure 7:
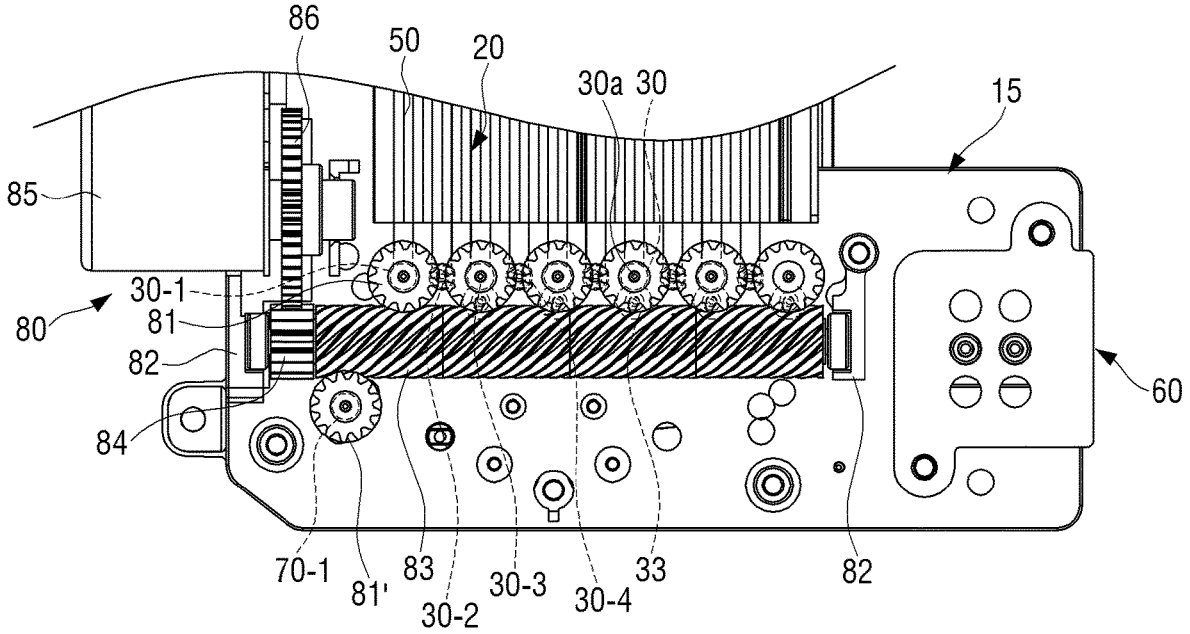
FIG. 7 is a view for explaining a relationship between a drive part and a plurality of first rollers of a belt type electric dust collection device according to an embodiment of the disclosure.

FIG. 3 is a perspective view illustrating a belt type electric dust collection device according to an embodiment of the disclosure. FIG. 4 is a rear perspective view illustrating the belt type electric dust collection device of FIG. 3. FIG. 5 is a partial perspective view illustrating a portion of the belt type electric dust collection device of FIG. 3. FIG. 6 is a partial rear perspective view illustrating a portion of the belt type electric dust collection device of FIG. 4. FIG. 7 is a view for explaining a relationship between a drive part and a plurality of first rollers of a belt type electric dust collection device according to an embodiment of the disclosure. For reference, FIGS. 3 to 6 do not show the plurality of electrode plates for convenience of illustration.

Referring to FIGS. 3 to 7, the belt type electric dust collection device 10 according to an embodiment of the disclosure may include a frame 15, the dust collecting belt 20, the plurality of first rollers 30, the plurality of second rollers 40, the plurality of electrode plates 50, the belt cleaning part 60, and the drive part 80.

The frame 15 fixes and supports the plurality of first rollers 30, the plurality of second rollers 40, the plurality of electrode plates 50, the belt cleaning part 60, and the drive part 80. An opening 16 is provided in a portion of the frame 15 corresponding to the dust collecting belt 20 so that air drawn in from the outside can pass therethrough. In FIGS. 3 to 6, only the lower frame 15 is disclosed, but an upper frame (not illustrated) may be disposed to support rotation of the plurality of first rollers 30 and the plurality of second rollers 40. The upper frame may be provided with the charging part 3 (see FIG. 1) for charging contaminants contained in the air introduced therein.

The dust collecting belt 20 is formed of an endless belt whose both ends are connected to each other, and is disposed to be overlapped in a zigzag form. Accordingly, the dust collecting belt 20 includes the plurality of flat portions 23 which face each other in parallel and are spaced apart from each other by a predetermined distance and the plurality of first bent portions 21 and second bent portions 22 provided at both ends of the plurality of flat portions 23. Since the plurality of flat portions 23 are positioned in the opening 16 of the frame 15, outside air passes between the plurality of flat portions 23 of the dust collecting belt 20.

The dust collecting belt 20 is formed such that contaminants charged in the charging part 3 may be attached thereto. Therefore, the dust collecting belt 20 is formed in a long film shape and is formed of a material having conductivity. For example, the dust collecting belt 20 may be formed of a plastic film having carbon coating on both surfaces thereof to have conductivity. Alternatively, the dust collecting belt 20 may be formed of a plastic film in which a conductive metal such as aluminum is deposited on both surfaces thereof.

The plurality of first rollers 30 and the plurality of second rollers 40 are disposed in the frame 15 to be spaced apart from each other by a predetermined interval. The plurality of first rollers 30 and the plurality of second rollers 40 support the dust collecting belt 20 so that the dust collecting belt 20 may move in a zigzag form while maintaining a predetermined interval and an overlapped state.

Accordingly, the dust collecting belt 20 is disposed to sequentially wind the plurality of first rollers 30 and second rollers 40 as illustrated in FIG. 3. Therefore, the dust collecting belt 20 is bent around the plurality of first rollers 30 to form the plurality of first bent portions 21, and is bent around the plurality of second rollers 40 to form the plurality of second bent portions 22. Because the dust collecting belt 20 is kept flat between the first bent portion 21 and the second bent portion 22 of the dust collecting belt 20, this is called as a flat portion 23 of the dust collecting belt 20. Accordingly, the plurality of flat portions 23 are formed between the plurality of first bent portions 21 and the plurality of second bent portions 22 of the dust collecting belt 20.

Accordingly, the plurality of first rollers 30 are disposed at one ends of the plurality of flat portions 23, that is, at the plurality of first bent portions 21 of the dust collecting belt 20 to support and guide the dust collecting belt 20 so that the dust collecting belt 20 can move. The plurality of first rollers 30 are disposed on the frame 15 to be spaced apart at equal intervals. The plurality of first rollers 30 are respectively rotatably supported by the frame 15.

The plurality of second rollers 40 are disposed at the other ends of the plurality of flat portions 23, that is, at the plurality of second bent portions 22 of the dust collecting belt 20 to support and guide the dust collecting belt 20 so that the dust collecting belt 20 can move. The plurality of second rollers 40 are formed to have the same diameter as the plurality of first rollers 30, and are disposed on the frame 15 to be spaced apart from each other at the same interval as that between the first rollers 30. Therefore, the plurality of flat portions 23 of the dust collecting belt 20 are spaced apart by the diameters of the first roller 30 and the second roller 40. The plurality of second rollers 40 are respectively rotatably supported by the frame 15.

In addition, the plurality of second rollers 40 are provided so as not to face the plurality of first rollers 30 in a direction parallel to the plurality of flat portions 23, that is, in the longitudinal direction of the frame 15. Therefore, when the dust collecting belt 20 is zigzagly disposed on the plurality of first rollers 30 and the plurality of second rollers 40, a plurality of first openings 11 facing the plurality of second rollers 40 are provided between the plurality of first rollers 30 around which the dust collecting belt 20 is wound. Similarly, a plurality of second openings 12 facing the plurality of first rollers 30 are provided between the plurality of second rollers 40 around which the dust collecting belt 20 is wound.

At least some of the plurality of first rollers 30 and the plurality of second rollers 40 are formed of a conductive material to allow electricity to flow to the dust collecting belt 20. At this time, only the outer circumferential surfaces of the first roller 30 and the second roller 40 may be formed of a conductive material. Alternatively, the entire first roller 30 and the entire second roller 40 may be formed of a conductive material.

The roller electricity conducting member 41 (see FIG. 2) is electrically connected to the plurality of first rollers 30 or the plurality of second rollers 40. Therefore, current may flow to the dust collecting belt 20 through the roller electricity conducting member 41, the first roller 30, and/or the second roller 40.

The plurality of electrode plates 50 (see FIG. 7) are provided between the plurality of flat portions 23 of the dust collecting belt 20. The plurality of electrode plates 50 may include a first electrode plate 51 and a second electrode plate 52 as illustrated in FIG. 2. In detail, the plurality of first electrode plates 51 are disposed between the plurality of flat portions 23 of the dust collecting belt 20 through the plurality of first openings 11 formed between the plurality of first rollers 30. In addition, the plurality of second electrode plates 52 are disposed between the plurality of flat portions 23 of the dust collecting belt 20 through the plurality of second openings 12 formed between the plurality of second rollers 40. Therefore, the plurality of first electrode plates 51 and the plurality of second electrode plates 52 are alternately provided between the plurality of flat portions 23 of the dust collecting belt 20. The plurality of first electrode plates 51 and the plurality of second electrode plates 52 are formed in the same manner, but the directions to be inserted between the plurality of flat portions 23 of the dust collecting belt 20 are different.

The plurality of electrode plates 50 are configured to form an electric field between the plurality of flat portions 23 of the dust collecting belt 20 so that the charged contaminants are attached to the dust collecting belt 20. A voltage having a polarity opposite to the dust collecting belt 20 is applied to the plurality of electrode plates 50. For example, when a negative (−) voltage or a low voltage is applied to the dust collecting belt 20 as illustrated in FIG. 2, a positive (+) voltage or a high voltage is applied to the plurality of electrode plates 50.

The plurality of electrode plates 50 are formed of a conductive material. For example, the electrode plates 50 may be formed of a plastic film having a carbon coating on both surfaces thereof.

Electrode plate conducting members 55 and 56 are electrically connected to the plurality of electrode plates 50. In detail, the plurality of first electrode plates 51 disposed through the plurality of first openings 11 between the plurality of first rollers 30 are electrically connected to a first electrode plate conducting member 55, and the plurality of second electrode plates 52 disposed through the plurality of second openings 12 between the plurality of second rollers 40 are electrically connected to a second electrode plate conducting member 56. The first electrode plate conducting member 55 is provided on the frame 15 at one side of the plurality of first rollers 30, and the second electrode plate conducting member 56 is provided on the frame 15 at one side of the plurality of second rollers 40. The same voltage is applied from the power supply part 90 to the first electrode plate conducting member 55 and the second electrode plate conducting member 56.

In this embodiment, the electrode plate conducting members 55 and 56 and the roller electricity conducting member 41 are provided such that a voltage of 6 kV is applied between the electrode plates 50 and the dust collecting belt 20. In addition, a gap between the electrode plate 50 and the flat portion 23 of the dust collecting belt 20 may be provided to be about 1.75 mm.

The drive part 80 generates a driving force so that the dust collecting belt 20 can be moved by the plurality of first rollers 30 and the plurality of second rollers 40. Therefore, the dust collecting belt 20 performs the endless track motion by the drive part 80. The drive part 80 may be provided at the rear side of the frame 15.

The drive part 80 is provided to drive at least one first roller 30 among the plurality of first rollers 30. Hereinafter, the drive part 80 will be described in detail with reference to FIGS. 6 and 7.

Referring to FIGS. 6 and 7, the drive part 80 may include a roller gear 81, a worm gear 83, and a drive motor 85.

The roller gear 81 is coaxially disposed at the shaft of at least one first roller 30 among the plurality of first rollers 30. In the case of this embodiment, one roller gear 81 is provided per two first rollers 30 in the plurality of first rollers 30. In other words, the roller gears 81 are provided one after another first roller 30 in the plurality of first rollers 30. For example, in the case where twelve first rollers 30 are disposed in a line as illustrated in FIG. 7, when the roller gear 81 is provided in the leftmost first roller 30-1, the roller gear 81 is not provided in the first roller 30-2 next to the first roller 30-1, and then the roller gear 81 is provided in the first roller 30-3 next to the first roller 30-2. Therefore, in the case of FIG. 7, the roller gears 81 are provided in six first rollers 30 among twelve first rollers 30.

The worm gear 83 is provided to mesh with the plurality of roller gears 81 provided in the plurality of first rollers 30. In the case of FIGS. 6 and 7, the worm gear 83 is provided to engage with the six roller gears 81 below the six roller gears 81. Therefore, when the worm gear 83 rotates, the six roller gears 81 rotate simultaneously.

Both ends of the worm gear 83 are rotatably supported by bearings provided at a pair of support brackets 82 disposed on the frame 15. The worm gear 83 is disposed to be rotatable by the drive motor 85. The worm gear 83 may be directly connected to the shaft of the drive motor 85. Alternatively, a reducer may be provided between the worm gear 83 and the drive motor 85.

In the case of the embodiment as illustrated in FIGS. 6 and 7, a reducer composed of a plurality of gears 84 and 86 is provided between the worm gear 83 and the drive motor 85. In detail, a pinion gear 86 is provided on the shaft of the drive motor 85, and a spur gear 84 meshing with the pinion gear 86 is provided on the worm gear 83. The spur gear 84 is integrally disposed coaxially with the worm gear 83. Therefore, when the spur gear 84 is rotated by the pinion gear 86, the worm gear 83 rotates integrally with the spur gear 84. In addition, because the number of teeth of the pinion gear 86 is larger than the number of teeth of the spur gear 84, the rotation of the drive motor 85 is decelerated and transmitted to the worm gear 83.

The drive motor 85 may use a motor that can rotate in one direction or in both directions.

A backup roller 33 may be provided at one side of the first roller 30 in which the roller gear 81 is disposed to face the first roller 30 and be rotated by the rotation of the first roller 30. In other words, the backup roller 33 may be provided to press the dust collecting belt 20 against the first roller 30. Because the backup roller 33 is rotatably disposed in the frame 15, the backup roller 33 rotates when the first roller 30 rotates. Thus, a large frictional force may be generated in the dust collecting belt 20 passing between the first roller 30 and the backup roller 33. Therefore, when the roller gear 81 is rotated by the drive motor 85, the dust collecting belt 20 may be moved by the first roller 30. In this case, a rubber layer may be formed on the outer circumferential surface of the backup roller 33 so as to increase the contact area with respect to the first roller 30.

In the case of the embodiment illustrated in FIG. 7, six backup rollers 33 are provided to correspond to the six first rollers 30 provided with the roller gears 81. However, the number of the backup rollers 33 is not limited thereto. When the frictional force between the first rollers 30 and the dust collecting belt 20 is sufficient, the number of the backup rollers 33 may be reduced. In other words, the number of the backup rollers 33 may be smaller than the number of the first rollers 30 provided with the roller gears 81.

In the above description, the roller gears 81 are provided one for every other first roller 30 in the plurality of first rollers 30. However, the arrangement of the roller gears 81 is not limited thereto. Depending on the driving force of the first rollers 30 for conveying the dust collecting belt 20, the number of roller gears 81 provided in the plurality of first rollers 30 may be reduced or increased.

Figure 8:
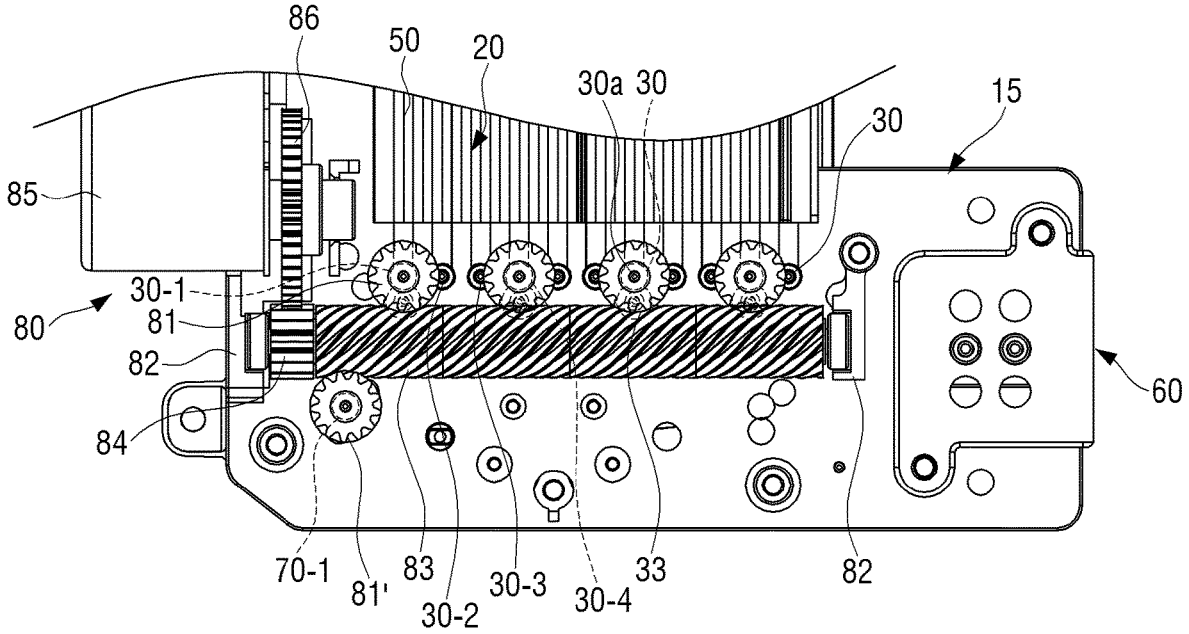
FIG. 8 is a view for explaining another arrangement example of a plurality of roller gears disposed in a plurality of first rollers of a belt type electric dust collection device according to an embodiment of the disclosure.

FIG. 8 is a view for explaining an arrangement example of a plurality of roller gears disposed in a plurality of first rollers of a belt type electric dust collection device according to an embodiment of the disclosure.

In the case of the embodiment illustrated in FIG. 8, the roller gears 81 are disposed one after every two first rollers 30 in the plurality of first rollers 30. In other words, one roller gear 81 is provided per three first rollers 30 in the plurality of first rollers 30. In the case where twelve first rollers 30 are disposed in a line as illustrated in FIG. 8, when the roller gear 81 is provided in the leftmost first roller 30-1, the roller gear 81 is not provided in the two first rollers 30-2 and 30-3 next to the first roller 30-1, and then the roller gear 81 is provided in the first roller 30-4 next to the first roller 30-3. Therefore, in the case of FIG. 8, the roller gears 81 are provided in four first rollers 30 among twelve first rollers 30. Thus, the worm gear 83 meshes with the four roller gears 81.

The belt cleaning part 60 is disposed at one side of the dust collecting belt 20 and is provided to remove contaminants attached to both surfaces of the dust collecting belt 20. In the case of the belt type electric dust collection device 10 according to this embodiment as illustrated in FIG. 3, the belt cleaning part 60 is disposed at a position different from the belt cleaning part 60 of the belt type electric dust collection device 10 of FIG. 2. However, the installation position of the belt cleaning part 60 is not limited to the positions of FIGS. 2 and 3. In other words, the belt cleaning part 60 may be disposed at any position as long as it can remove contaminants from the dust collecting belt 20.

The belt cleaning part 60 is disposed to be spaced apart from the outermost first roller 30-12 among the plurality of first rollers 30 in the width direction of the dust collecting belt 20, that is, in the width direction of the frame 15.

A plurality of guide rollers 70 for guiding the dust collecting belt 20 which comes out from the outermost first roller 30-12 to the belt cleaning part 60 and returning the dust collecting belt 20 which has passed the belt cleaning part 60 back to the opposite outermost first roller 30-1 among the plurality of first rollers 30 may be disposed on both sides of the belt cleaning part 60.

A roller gear 81' may be disposed in one guide roller 70-1 for guiding the dust collecting belt 20 coming out from the belt cleaning part 60 to the plurality of first rollers 30 among the plurality of guide rollers 70. The roller gear 81' is meshed with the worm gear 83. Therefore, when the worm gear 83 rotates, the roller gear 81' is rotated, and thereby the guide roller 70-1 is also rotated. At this time, a guide backup roller 71 rotated by the guide roller 70-1 may be provided to increase the frictional force between the guide roller 70-1 and the dust collecting belt 20.

The roller gear 81' disposed in the guide roller 70-1 is formed in the same manner as the roller gears 81 provided in the plurality of first rollers 30 as described above. When the roller gear 81' is provided in the guide roller 70-1 as described above, the dust collecting belt 20 may pass smoothly through the belt cleaning part 60.

Figure 9:
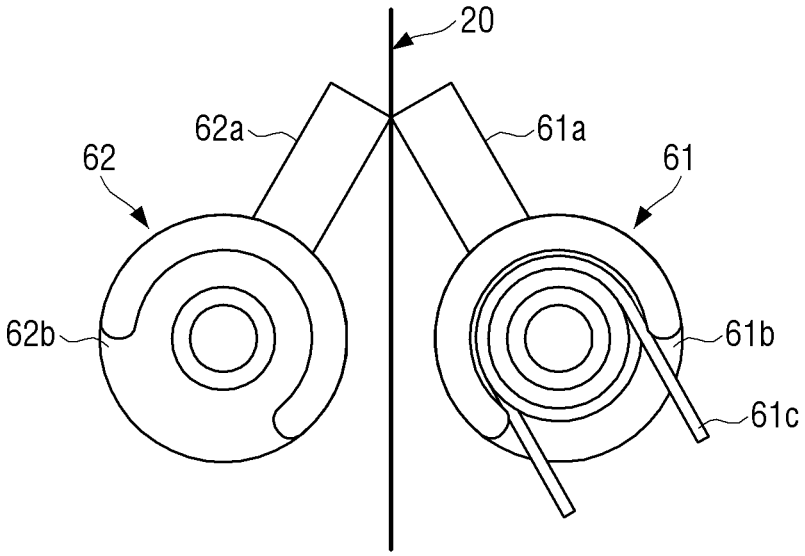
FIG. 9 is a view illustrating an example of a cleaning member of a belt cleaning part of a belt type electric dust collection device according to an embodiment of the disclosure.

Referring to FIGS. 5 and 9, the belt cleaning part 60 may include a first cleaning member 61, a second cleaning member 62, and a contaminants container 63.

FIG. 9 is a view illustrating an example of a cleaning member of a belt cleaning part of a belt type electric dust collection device according to an embodiment of the disclosure.

The first cleaning member 61 is provided to remove contaminants attached to one surface of the dust collecting belt 20, and the second cleaning member 62 is provided to remove contaminants attached to the opposite surface of the dust collecting belt 20. In other words, the second cleaning member 62 is disposed to clean the opposite surface of the dust collecting belt 20 which is not cleaned by the first cleaning member 61.

The first cleaning member 61 may include a blade 61*a*, a blade holder 61*b* configured to fix the blade 61*a*, and a pressing member 61*c* configured to press the blade 61*a* toward the dust collecting belt 20. The blade 61*a* is formed in a rectangular plate shape, and one end of the blade 61*a* is fixed to the blade holder 61*b*. The blade 61*a* is disposed so that an edge of the blade 61*a* contacts the surface of the dust collecting belt 20. At this time, the blade holder 61*b* is supported by the pressing member 61*c* so that the blade 61*a* applies a predetermined force to the dust collecting belt 20. A torsion spring may be used as the pressing member 61*c*. The blade 61*a* may be formed of a rubber material so as not to damage the dust collecting belt 20.

The second cleaning member 62 may include a blade 62*a*, a blade holder 62*b* configured to fix the blade 62*a*, and a pressing member configured to press the blade 62*a* toward the dust collecting belt 20 in the same manner as the first cleaning member 61. Therefore, a detailed description thereof is omitted. However, as illustrated in FIG. 9, the second cleaning member 62 may not be provided with a pressing member, if necessary.

As illustrated in FIG. 9, the first cleaning member 61 and the second cleaning member 62 may be disposed to face each other with the dust collecting belt 20 interposed therebetween.

Figure 10:
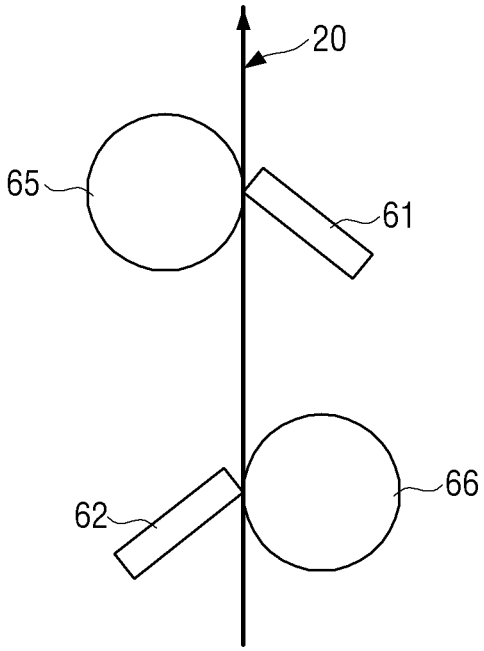
FIG. 10 is a view illustrating another example of a cleaning member of a belt cleaning part of a belt type electric dust collection device according to an embodiment of the disclosure.

As another example, as illustrated in FIG. 10, the first cleaning member 61 and the second cleaning member 62 may be disposed at a predetermined interval along the moving direction of the dust collecting belt 20.

FIG. 10 is a view illustrating another example of a cleaning member of a belt cleaning part of a belt type electric dust collection device according to an embodiment of the disclosure.

Referring to FIG. 10, the first cleaning member 61 and the second cleaning member 62 are disposed to be spaced apart by a predetermined distance from each other in the traveling direction of the dust collecting belt 20. At this time, a first support part 65 is provided on the opposite side of a portion of the dust collecting belt 20 in contact with the first cleaning member 61, and supports the opposite surface of the portion of the dust collecting belt 20 pressed by the first cleaning member 61. In addition, a second support part 66 is provided on the opposite side of a portion of the dust collecting belt 20 in contact with the second cleaning member 62, and supports the opposite surface of the portion of the dust collecting belt 20 pressed by the second cleaning member 62. The first support part 65 and the second support part 66 may each be formed in a cylindrical roller.

Therefore, when the dust collecting belt 20 passes between the first cleaning member 61 and the first support part 65, contaminants attached to one surface of the dust collecting belt 20 are removed by the first cleaning member 61. In addition, when the dust collecting belt 20 passes between the second cleaning member 62 and the second support part 66, contaminants attached to the other surface of the dust collecting belt 20 are removed by the second cleaning member 61.

Figure 11:
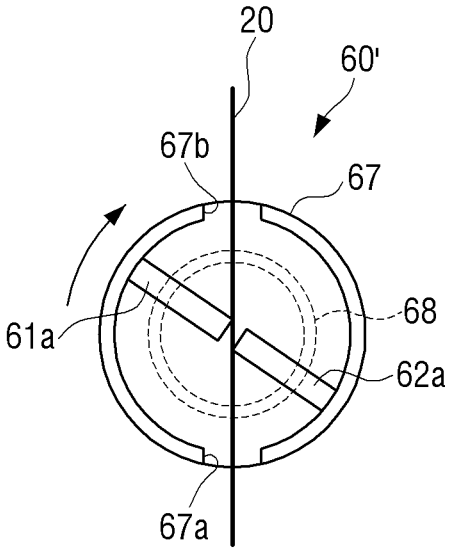
FIG. 11 is a view illustrating another example of a cleaning member of a belt cleaning part of a belt type electric dust collection device according to an embodiment of the disclosure.

As another example, as illustrated in FIG. 11, two blades may be provided in a diagonal direction with respect to the dust collecting belt 20.

FIG. 11 is a view illustrating another example of a cleaning member of a belt cleaning part of a belt type electric dust collection device according to an embodiment of the disclosure.

Referring to FIG. 11, a first blade 61*a* and a second blade 62*a* are disposed to face each other inside a blade holder 67. The blade holder 67 is formed in a hollow cylindrical shape, and provided with an inlet slot 67*a* through which the dust collecting belt 20 enters and an outlet slot 67*b* through which the dust collecting belt 20 exits in the outer circumferential surface thereof. The inlet slot 67*a* and the outlet slot 67*b* are formed to face each other in the outer circumferential surface of the blade holder 67. The blade holder 67 is disposed to rotate at a predetermined angle with respect to the dust collecting belt 20 by a pressing member 68. Thus, the edge of the first blade 61*a* is in contact with one surface of the dust collecting belt 20, and the edge of the second blade 62*a* is in contact with the opposite surface of the dust collecting belt 20. In other words, the first blade 61*a* and the second blade 62*a* are provided in a diagonal direction with respect to the dust collecting belt 20 as illustrated in FIG. 11. The cleaning member 60' having this structure may be configured to discharge the contaminants removed from the dust collecting belt 20 by the first blade 61*a* and the second blade 62*a* downward along the inner space of the blade holder 67. Therefore, a separate contaminants container 63 to be described later may not be provided.

The contaminants container 63 is provided to surround the first cleaning member 61 and the second cleaning member 62, and is configured to collect the contaminants removed from the dust collecting belt 20 by the first cleaning member 61 and the second cleaning member 62. In addition, the contaminants container 63 may prevent the removed contaminants from scattering to the outside when the first cleaning member 61 and the second cleaning member 62 remove the contaminants from the dust collecting belt 20. The contaminants container 63 is provided with a belt inlet 63*a* through which the dust collecting belt 20 is introduced between the first and second cleaning members 61 and 62 and a belt outlet 63*b* through which the dust collecting belt 20 passed between the first and second cleaning members 61 and 62 exits, so that the dust collecting belt 20 can pass through the contaminants container 63.

In the above description, the first cleaning member 61 and the second cleaning member 62 are formed of a rectangular plate-shaped blade. However, the first cleaning member 61 and the second cleaning member 62 are not limited thereto.

Figure 12:
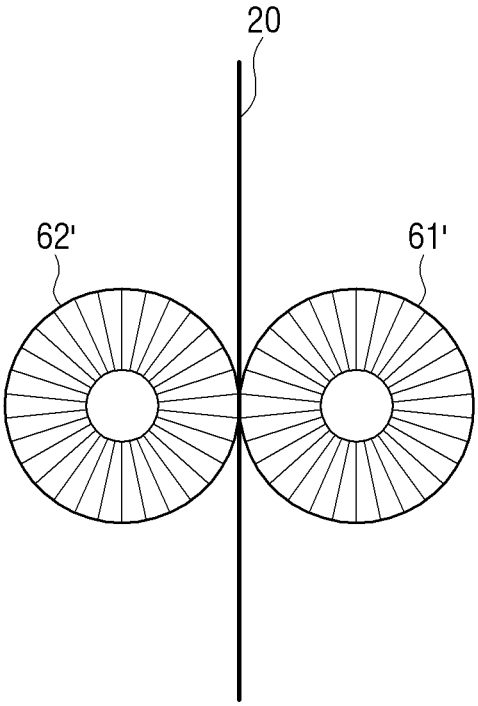
FIG. 12 is a view illustrating another example of a cleaning member of a belt cleaning part of a belt type electric dust collection device according to an embodiment of the disclosure.

The first cleaning member and the second cleaning member may be formed of a cylindrical cleaner as illustrated in FIG. 12.

FIG. 12 is a view illustrating another example of a cleaning member of a belt cleaning part of a belt type electric dust collection device according to an embodiment of the disclosure.

As illustrated in FIG. 12, the first cleaning member 61' is provided to rotate in contact with one surface of the dust collecting belt 20, and the second cleaning member 62' is provided to rotate in contact with the opposite surface of the dust collecting belt 20. At this time, the first cleaning member 61' and the second cleaning member 62' are disposed to face each other with the dust collecting belt 20 interposed therebetween. The first cleaning member 61' and the second cleaning member 62' are formed in a cylindrical shape and may be provided to rotate by receiving power from the drive part 80.

The first and second cleaning members 61' and 62' may be formed in a cylindrical brush as illustrated in FIG. 12. Alternatively, although not illustrated, they may be formed in the form of a cylindrical polishing wheel or a cylindrical buffing wheel formed of a flexible material such as fibers used for polishing or buffing.

In addition, the first cleaning member and the second cleaning member may be formed in various shapes and of various materials as long as they can remove contaminants attached to the surface of the dust collecting belt 20 without damaging the surface of the dust collecting belt 20.

In the above description, the belt cleaning part 60 is disposed in one position. However, the number of the belt cleaning part 60 is not limited thereto. In order to quickly remove the contaminants attached to the dust collecting belt 20, a plurality of belt cleaning parts 60 may be provided.

Figure 13:
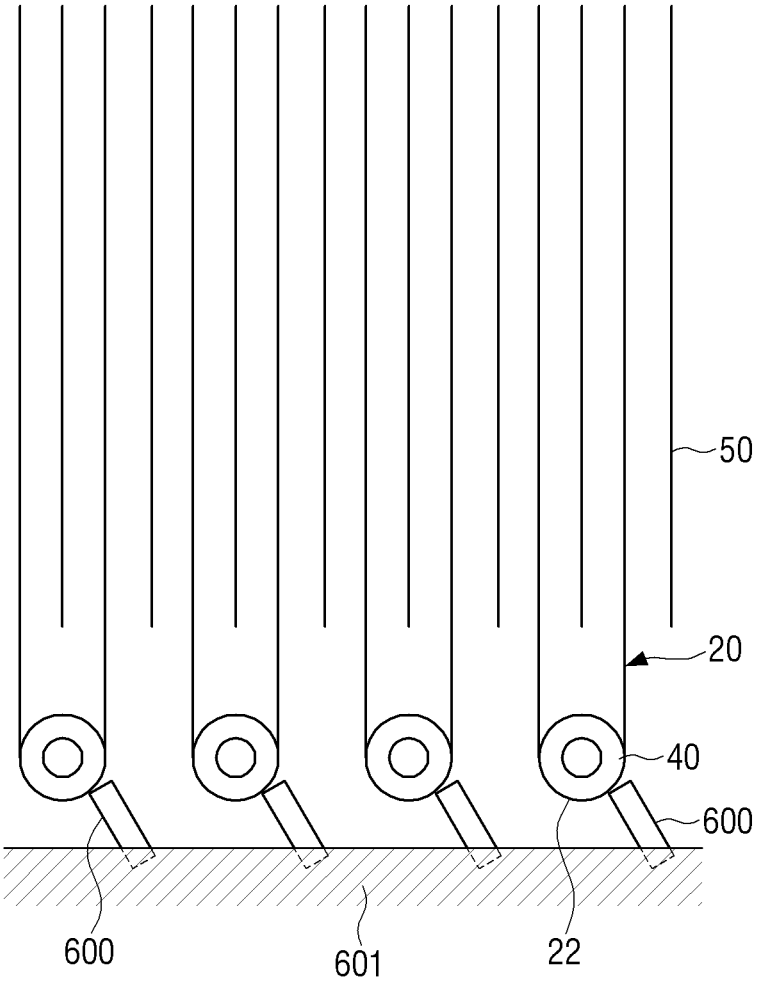
FIG. 13 is a view illustrating a case where a plurality of belt cleaning parts are disposed in a belt type electric dust collection device according to an embodiment of the disclosure.

FIG. 13 is a view illustrating a case where a plurality of belt cleaning parts are disposed in a belt type electric dust collection device according to an embodiment of the disclosure.

Referring to FIG. 13, a plurality of belt cleaning parts 600 are provided in the plurality of second bent portions 22 of the dust collecting belt 20 supported by the plurality of second rollers 40.

The belt cleaning parts 600 are formed in a blade shape, and a plurality of blades 600 are supported by one holder 601. The contaminants removed from the dust collecting belt 20 by the plurality of blades 600 may be collected by falling in a direction perpendicular to the drawing.

In FIG. 13, the blades 600 are provided in all the plurality of second rollers 40. However, the disclosure is not limited thereto. The blades 600 may be provided only in two of the plurality of second rollers 40. Alternatively, a plurality of blades may be provided in the plurality of first rollers 30. As another example, the blade 600 may be provided in one of the plurality of first rollers 30, and the blade 600 may be provided in one of the plurality of second rollers 40.

Hereinafter, an operation of the belt type electric dust collection device according to an embodiment of the disclosure will be described with reference to FIGS. 2 to 6.

The charging part 3 (see FIG. 1) is provided in front of the belt type electric dust collection device 10 according to an embodiment of the disclosure. Therefore, while the outside air passes through the charging part 3, contaminants or fine materials contained in the air are charged with positive charges.

The air having passed through the charging part 3 is introduced into the belt type electric dust collection device 10 according to an embodiment of the disclosure. The introduced air passes through the flow path 13 formed in parallel with one dust collecting belt 20 and the plurality of electrode plates 50, and then is discharged from the belt type electric dust collection device 10.

When the introduced air passes through the flow path 13 formed with dust collecting belt 20 and the plurality of electrode plates 50, the contaminants charged by the positive charges are attached to the dust collecting belt 20 serving as the negative electrode. At this time, because the dust collecting belt 20 and the plurality of electrode plates 50 having a thin thickness are disposed in parallel in the flow path 13 through which the air passes, the flow resistance acting on the introduced air may be minimized.

When the contaminants are attached to the dust collecting belt 20, the contaminants become resistance, so the contaminant collecting performance of the dust collecting belt 20 may be reduced. Therefore, when a predetermined time elapses, the dust collecting belt 20 is conveyed to the belt cleaning part 60 to remove the contaminants attached to the dust collecting belt 20.

When the drive motor 85 is turned on, the pinion gear 86 provided on the shaft of the drive motor 85 rotates. When the pinion gear 86 rotates, the spur gear 84 meshed with the pinion gear 86 is rotated. Because the spur gear 84 is integrally provided with the worm gear 83, when the spur gear 84 rotates, the worm gear 83 rotates integrally. When the worm gear 83 rotates, the plurality of roller gears 81 engaged with the worm gear 83 are rotated in one direction. When the plurality of roller gears 81 rotate, the first roller 30 coaxially disposed in each of the plurality of roller gears 81 rotates. When the plurality of first rollers 30 rotate, the dust collecting belt 20 is moved by the frictional force between the plurality of first rollers 30 and the dust collecting belt 20.

When the dust collecting belt 20 moves, a portion of the dust collecting belt 20 to which contaminants are attached passes through the belt cleaning part 60. When the dust collecting belt 20 passes through the belt cleaning part 60, the first cleaning member 61 of the belt cleaning part 60 removes the contaminants attached to one surface of the dust collecting belt 20, and the second cleaning member 62 removes the contaminants attached to the opposite surface of the dust collecting belt 20. When the dust collecting belt 20 is rotated once so that entire portions of the dust collecting belt 20 pass through the belt cleaning part 60, the contaminants attached to both surfaces of the dust collecting belt 20 are removed, so that the dust collecting belt 20 may restore the original contaminant collecting performance again.

In the above description, the dust collecting belt 20 has been cleaned at regular time intervals. However, the disclosure is not limited thereto. The disclosure may be configured not to perform a cleaning mode for separately cleaning the dust collecting belt 20, but to move the dust collecting belt 20 while the belt type electric dust collection device 10 performs the contaminant collection function, so that the contaminant collection function and the cleaning function are simultaneously performed.

Hereinafter, a belt type electric dust collection device according to another embodiment of the disclosure will be described with reference to FIGS. 14 to 17.

Figure 14:
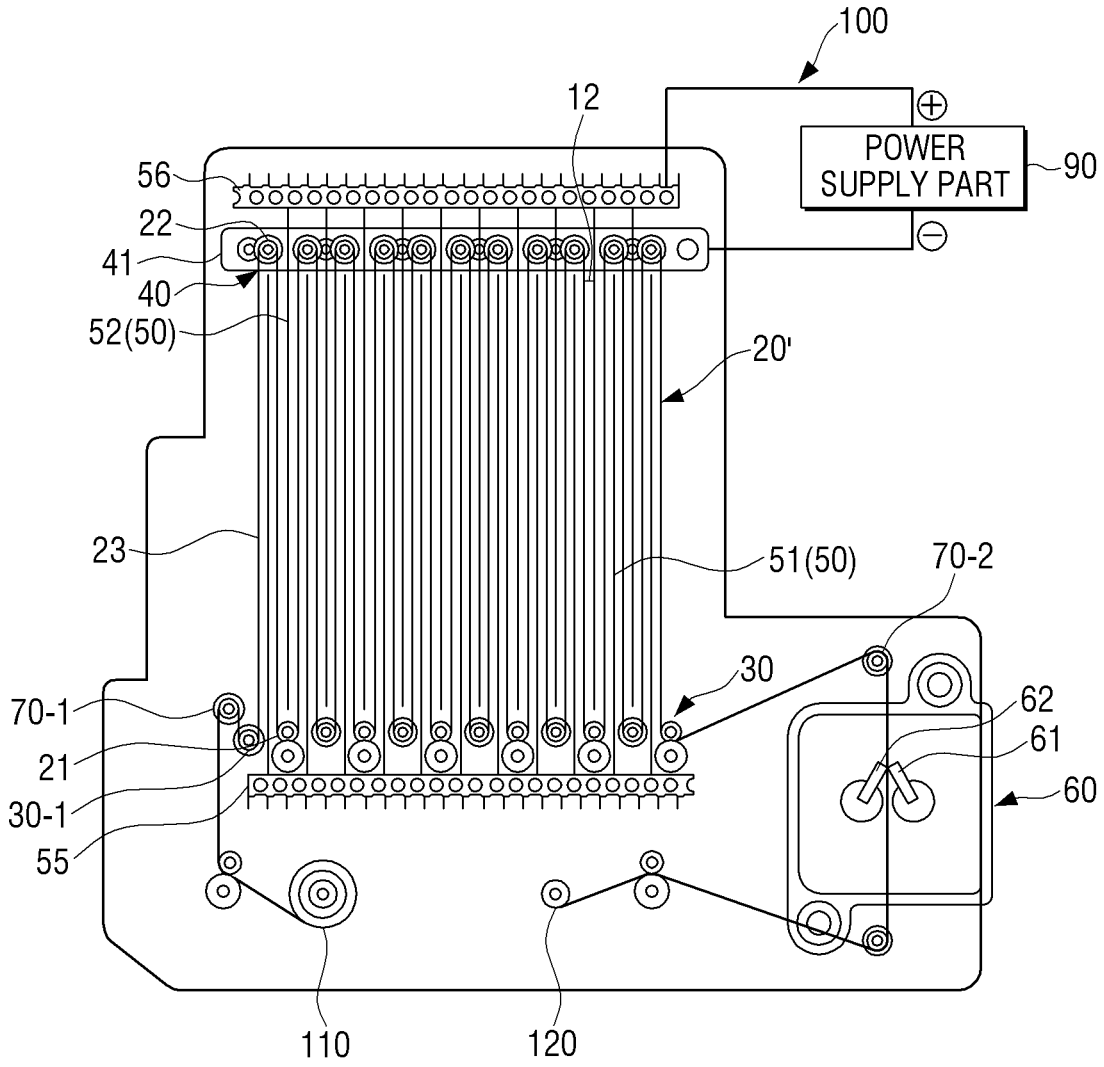
FIG. 14 is a view conceptually illustrating a belt type electric dust collection device according to another embodiment of the disclosure.
Figure 15:
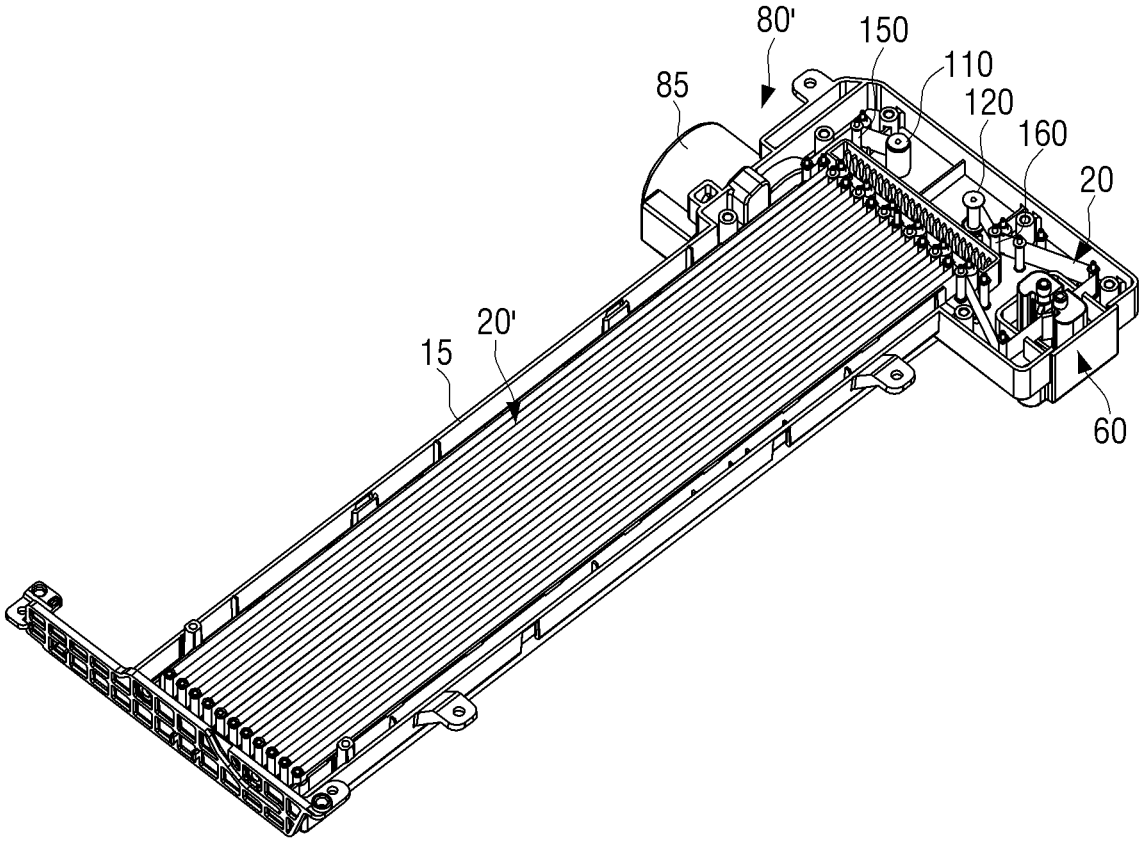
FIG. 15 is a perspective view illustrating a belt type electric dust collection device according to another embodiment of the disclosure.
Figure 16:
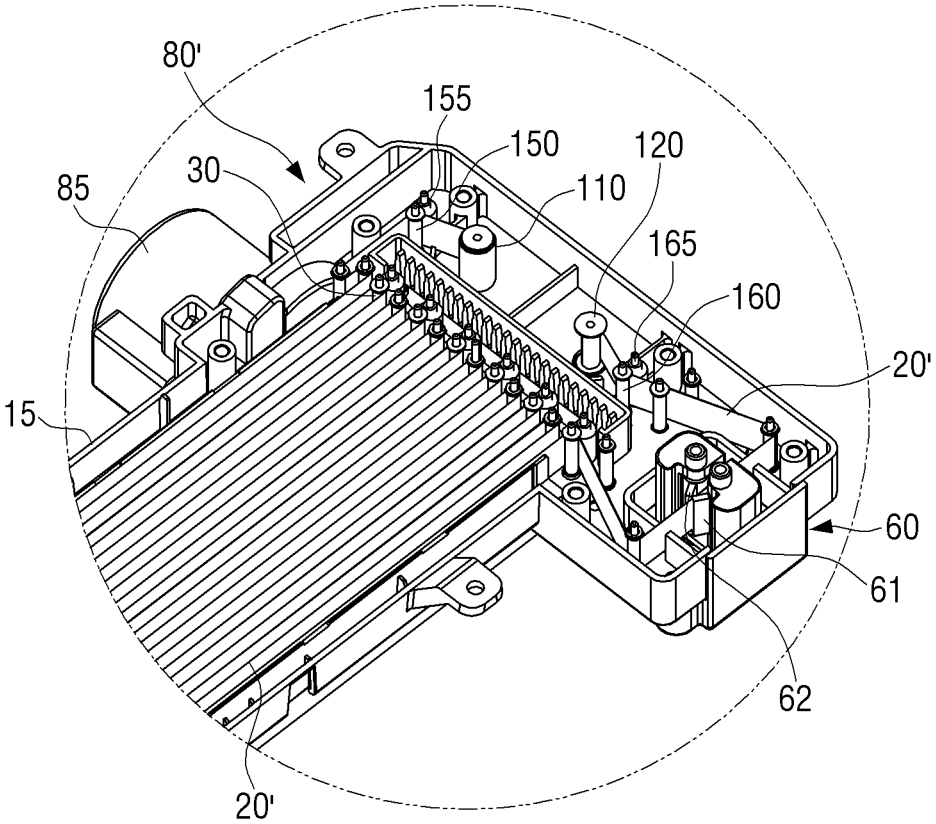
FIG. 16 is a partial perspective view illustrating a portion of the belt type electric dust collection device of FIG. 15.
Figure 17:
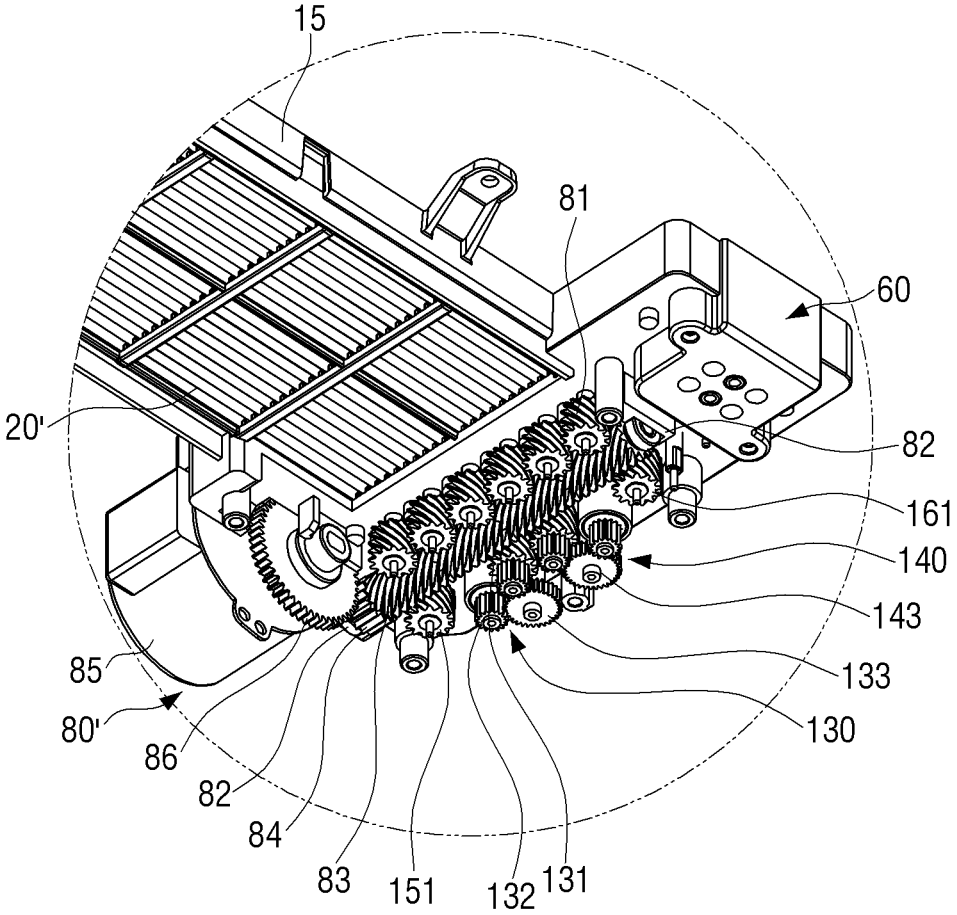
FIG. 17 is a partial rear perspective view illustrating a portion of the belt type electric dust collection device of FIG. 15.
Figure 18:
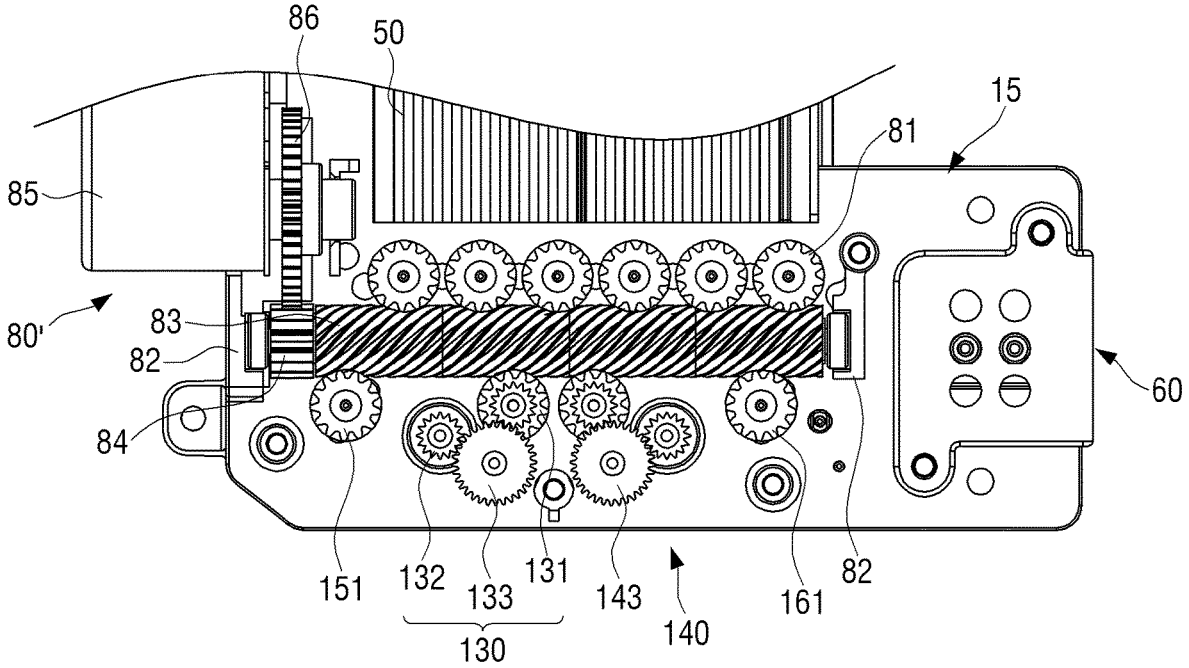
FIG. 18 is a partial rear view illustrating a portion of the belt type electric dust collection device of FIG. 15.

FIG. 14 is a view conceptually illustrating a belt type electric dust collection device according to another embodiment of the disclosure. FIG. 15 is a perspective view illustrating a belt type electric dust collection device according to another embodiment of the disclosure. FIG. 16 is a partial perspective view illustrating a portion of the belt type electric dust collection device of FIG. 15. FIG. 17 is a partial rear perspective view illustrating a portion of the belt type electric dust collection device of FIG. 15. FIG. 18 is a partial rear view illustrating a portion of the belt type electric dust collection device of FIG. 15.

Referring to FIGS. 14 to 16, a belt type electric dust collection device 100 according to an embodiment of the disclosure may include a frame 15, a dust collecting belt 20', a plurality of first rollers 30, a plurality of second rollers 40, a plurality of electrode plates 50, a belt cleaning part 60, a drive part 80', a first winding roller 110, and a second winding roller 120.

The belt type electric dust collection device 100 as illustrated in FIGS. 14 to 16 is different from the belt type electric dust collection device 10 according to the above-described embodiment in which the dust collecting belt 20 is an endless belt in that the dust collecting belt 20' is cut. In other words, the dust collecting belt 20' used in the belt type electric dust collection device 100 according to this embodiment is formed in a band shape with both ends.

Therefore, the frame 15, the plurality of first rollers 30, the plurality of second rollers 40, the plurality of electrode plates 50, and the belt cleaning part 60 of the belt type electric dust collection device 100 according to an embodiment of the disclosure are the same as or similar to those of the belt type electric dust collection device 10 according to the above-described embodiment; therefore, detailed descriptions thereof are omitted.

One end of the dust collecting belt 20' is fixed to the first winding roller 110, and the other end of the dust collecting belt 20' is fixed to the second winding roller 120. The dust collecting belt 20' has a length longer than an installation length from the first winding roller 110 to the belt cleaning part 60. The dust collecting belt 20' has a length such that all portion corresponding to the installation length can pass through the belt cleaning part 60. Here, the installation length is referred to as a length of the dust collecting belt 20' from the first guide roller 70-1 to a point which the dust collecting belt 20' is in contact with the first cleaning member 61 and the second cleaning member 62 of the belt cleaning part 60 after passing the second guide roller 70-2 including a portion folded in a zigzag manner by the plurality of first rollers 30 and the plurality of second rollers 40. In order to clean the dust collecting belt 20' with the belt cleaning part 60, all portions of the dust collecting belt 20' corresponding to the installation length need to pass through the belt cleaning part 60. Therefore, the dust collecting belt 20' is formed to have approximately twice the length of the installation length, and after the dust collecting belt 20' is provided between the plurality of first rollers 30 and the plurality of second rollers 40, the portion of the remaining dust collecting belt 20' is wound around the first winding roller 110.

Thus, in order to remove the contaminants attached to the dust collecting belt 20', when the second winding roller 120 is rotated in the winding direction, the dust collecting belt 20' wound around the first winding roller 110 is unwound, and then the installation portion of the dust collecting belt 20' supported by the plurality of first rollers 30 and the plurality of second rollers 40 passes through the belt cleaning part 60 and is wound around the second winding roller 120.

The dust collecting belt 20' is made of a conductive flexible material. Because the material of the dust collecting belt 20' is the same as the dust collecting belt 20 of the belt type electric dust collection device 10 according to the above-described embodiment, a detailed description thereof is omitted.

The first winding roller 110 and the second winding roller 120 are provided in the frame 15 to be rotated in both directions by the drive part 80' and winds or unwinds the dust collecting belt 20'. The first winding roller 110 and the second winding roller 120 are disposed spaced apart by a predetermined interval at one side of the plurality of first rollers 30.

The drive part 80' is configured to generate a driving force so that the dust collecting belt 20' moves along the plurality of first rollers 30 and the plurality of second rollers 40 and is wound or unwound around or from the first winding roller 110 and the second winding roller 120. Therefore, the dust collecting belt 20' is moved by the drive part 80', and thereby wound around or unwound from the first winding roller 110 or the second winding roller 120. The drive part 80' may be provided in the rear surface of the frame 15.

The drive part 80' is provided to drive at least one of the plurality of first rollers 30, the first winding roller 110, and the second winding roller 120. Hereinafter, the drive part 80' will be described in detail with reference to FIGS. 17 and 18.

Referring to FIGS. 17 and 18, the drive part 80' may include a roller gear 81, a worm gear 83, a first winding gear train 130, a second winding gear train 140, and a drive motor 85.

The roller gear 81 is coaxially disposed on the shaft of the at least one of the plurality of first rollers 30. In the case of this embodiment, one roller gear 81 is provided per two first rollers 30 in the plurality of first rollers 30. In other words, the roller gears 81 are provided one after every other first roller 30 in the plurality of first rollers 30. For example, in the case where twelve first rollers 30 are disposed in a line as illustrated in FIG. 18, when the roller gear 81 is provided in the leftmost first roller 30-1, the roller gear 81 is not provided in the first roller 30-2 next to the first roller 30-1, and the roller gear 81 is provided in the first roller 30-3 next to the first roller 30-2. Therefore, in the case of FIG. 18, the roller gears 81 are provided in six first rollers 30 among twelve first rollers 30.

The worm gear 83 is provided to engage with the plurality of roller gears 81 provided in the plurality of first rollers 30. In the case of FIGS. 17 and 18, the worm gear 83 is provided to engage with the six roller gears 81 under the six roller gears 81. Therefore, when the worm gear 83 rotates, the six roller gears 81 are rotated simultaneously.

Both ends of the worm gear 83 are rotatably supported by bearings provided at a pair of support brackets 82 disposed on the frame 15. The worm gear 83 is disposed to be rotatable by the drive motor 85. The worm gear 83 may be directly connected to the shaft of the drive motor 85. Alternatively, a reducer may be provided between the worm gear 83 and the drive motor 85.

In the case of the embodiment as illustrated in FIGS. 17 and 18, a reducer composed of a plurality of gears 84 and 86 is provided between the worm gear 83 and the drive motor 85. In detail, a pinion gear 86 is provided on the shaft of the drive motor 85, and a spur gear 84 meshing with the pinion gear 86 is provided on the worm gear 83. The spur gear 84 is integrally disposed coaxially with the worm gear 83. Therefore, when the spur gear 84 rotates, the worm gear 83 rotates integrally. In addition, because the number of teeth of the pinion gear 86 is larger than the number of teeth of the spur gear 84, the rotation of the drive motor 85 is decelerated and transmitted to the worm gear 83.

The first winding gear train 130 is provided to transmit the rotational force of the worm gear 83 to the first winding roller 110. The first winding gear train 130 is configured to reduce the rotational speed of the worm gear 83 and to transmit it to the first winding roller 110. When the radius of the dust collecting belt 20' wound around the first winding roller 110 becomes larger than the radius of the first roller 30, the speed at which the first winding roller 110 winds the dust collecting belt 20' is faster than the conveying speed at which the first rollers 30 conveys the dust collecting belt 20', thereby increasing overall the conveying force of the dust collecting belt 20'. On the contrary, when the first winding roller 110 is released, the tension of the releasing side is weakened, which may cause a problem that the gap between the dust collecting belt 20' and the electrode plate 50 is not maintained. Therefore, the first winding gear train 130 is provided to reduce the rotational speed of the worm gear 83 and to transmit it to the first winding roller 110.

As an example, the first winding gear train 130 may include a connection gear 131 meshing with the worm gear 83, a winding gear 133 coaxially disposed on the first winding roller 110, and an idle gear 132 disposed between the connection gear 131 and the winding gear 133. The connection gear 131 and the idle gear 132 are rotatably disposed in the frame 15.

A one-way clutch 135 may be provided between the winding gear 133 and the shaft of the first winding roller 110. The one-way clutch 135 is provided so that the first winding roller 110 rotates freely without transmitting the rotation of the winding gear 133 to the first winding roller 110 in the direction in which the first winding roller 110 winds up the dust collecting belt 20' and the first winding roller 110 rotates integrally with the winding gear 133 by the rotation of the winding gear 133 transmitted to the first winding roller 110 in the direction in which the first winding roller 110 releases the dust collecting belt 20'. When the one-way clutch 135 is provided between the winding gear 133 and the first winding roller 110 as described above, the overall conveying speed of the dust collecting belt 20' may be prevented from being changed by dust collecting belt 20' being wound around the first winding roller 110.

The second winding gear train 140 is provided to transmit the rotational force of the worm gear 83 to the second winding roller 120. The second winding gear train 140 is formed to reduce the rotational speed of the worm gear 83 and to transmit it to the second winding roller 120. Because the second winding gear train 140 may be formed in the same manner as the first winding gear train 130, a detailed description thereof is omitted.

In addition, a one-way clutch 145 may be provided between the winding gear 143 of the second winding gear train 140 and the shaft of the second winding roller 120. The installation direction of the one-way clutch 145 is the same as that of the one-way clutch 135 provided between the winding gear 133 of the first winding gear train 130 and the first winding roller 110 as described above; therefore, a detailed description thereof is omitted.

In front of the first winding roller 110, that is, between the first winding roller 110 and the plurality of first rollers 30, a first regulating roller 150 may be provided to convey the dust collecting belt 20' to the first winding roller 110 or to convey the dust collecting belt 20' being released from the first winding roller 110 toward the plurality of first rollers 30.

The first regulating roller 150 is disposed to rotate by receiving power from the worm gear 83. Therefore, a first regulating gear 151 is coaxially disposed on the shaft of the first regulating roller 150, and the first regulating gear 151 is meshed with the worm gear 83. Accordingly, when the worm gear 83 rotates, the first regulating gear 151 is rotated, and thereby the first regulating roller 150 is rotated integrally. The first regulating roller 150 is rotatably disposed in the frame 15.

In addition, a regulating backup roller 155 may be provided to face the first regulating roller 150 and rotate by the rotation of the first regulating roller 150 at one side of the first regulating roller 150. In other words, the regulating backup roller 155 may be disposed to press the dust collecting belt 20' against the first regulating roller 150. Thus, a large frictional force may be generated between the dust collecting belt 20' and the first regulating roller 150.

A second regulating roller 160 may be provided to convey the dust collecting belt 20' to the second winding roller 120 or to convey the dust collecting belt 20' being released from the second winding roller 120 toward the belt cleaning part 60 in front of the second winding roller 120, that is, between the second winding roller 120 and the belt cleaning part 60. The dust collecting belt 20' that has passed through the belt cleaning part 60 moves to the plurality of first rollers 30.

The second regulating roller 160 may be formed in the same manner as the first regulating roller 150. In other words, the second regulating roller 160 is disposed to rotate by receiving power from the worm gear 83. Therefore, a second regulating gear 161 is coaxially disposed on the shaft of the second regulating roller 160, and the second regulating gear 161 is meshed with the worm gear 83. Accordingly, when the worm gear 83 rotates, the second regulating gear 161 is rotated, and thereby the second regulating roller 160 is rotated integrally. The second regulating roller 160 is rotatably disposed in the frame 15.

In addition, a regulating backup roller 165 may be provided to face the second regulating roller 160 and rotate by the rotation of the second regulating roller 160 at one side of the second regulating roller 160. In other words, the regulating backup roller 165 may be disposed to press the dust collecting belt 20' against the second regulating roller 160. Thus, a large frictional force may be generated between the dust collecting belt 20' and the second regulating roller 160.

The drive motor 85 may use a motor capable of bidirectional rotation.

A backup roller 33 may be provided to face the first roller 30 and be rotated by the rotation of the first roller 30 at one side of the first roller 30 in which the roller gear 81 is disposed. In other words, the backup roller 33 may be provided to press the dust collecting belt 20' against the first roller 30. Thus, a large frictional force may be generated between the dust collecting belt 20' and the first roller 30. Therefore, when the roller gear 81 is rotated by the drive motor 85, the dust collecting belt 20' may be moved by the first roller 30. In this case, a rubber layer may be formed on the outer circumferential surface of the backup roller 33 so as to increase the contact area with respect to the first roller 30.

In the case of the embodiment illustrated in FIG. 18, six backup rollers 33 are provided to correspond to the six first rollers 30 provided with the roller gears 81. However, the number of the backup rollers 33 is not limited thereto. When the frictional force between the first rollers 30 and the dust collecting belt 20' is sufficient, the number of the backup rollers 33 may be reduced. In other words, the number of the backup rollers 33 may be smaller than the number of the first rollers 30 provided with the roller gears 81.

In the above description, the roller gears 81 are provided one for every other first rollers 30 in the plurality of first rollers 30. However, the arrangement of the roller gears 81 is not limited thereto. The number of roller gear 81 may be reduced or increased depending on the driving force of the first rollers 30 for conveying the dust collecting belt 20'.

Hereinafter, an operation of the belt type electric dust collection device 100 according to an embodiment of the disclosure will be described with reference to FIGS. 14 to 18.

A process through which the belt type electric dust collection device 100 according to an embodiment of the disclosure causes contaminants or fine materials contained in the introduced air to be attached to the dust collecting belt 20' so as to clean the air is the same as that of the belt type electric dust collection device 10 according to the above-described embodiment; therefore, a detailed description thereof is omitted.

When the contaminants are attached to the dust collecting belt 20', the contaminants become resistance, so the contaminant collecting performance of the dust collecting belt 20' is reduced. Therefore, when a predetermined time elapses, the dust collecting belt 20' is conveyed to the belt cleaning part 60 to remove the contaminants attached to the dust collecting belt 20'.

When the drive motor 85 is turned on, the pinion gear 86 provided on the shaft of the drive motor 85 rotates. When the pinion gear 86 rotates, the spur gear 84 meshed with the pinion gear 86 is rotated. Because the spur gear 84 is integrally provided coaxially with the worm gear 83, when the spur gear 84 rotates, the worm gear 83 rotates integrally.

When the worm gear 83 rotates, the plurality of roller gears 81, the first regulating gear 151, and the second regulating gear 161 engaged with the worm gear 83 are rotated in one direction. The first winding gear train 130 and the second winding gear train 140 also transmit the power of the worm gear 83 to the first winding gear 133 and the second winding gear 143, and thereby the first winding gear 133 and the second winding gear 143 are rotated in one direction.

At this time, because the dust collecting belt 20' is wound around the first winding roller 110 to which the first winding gear 133 is coupled, the first winding gear 133 rotates in a direction to release the dust collecting belt 20', and the second winding gear 143 rotates in a direction in which the second winding roller 120 winds up the dust collecting belt 20'. At this time, the first winding roller 110 rotates integrally with the first winding gear 133 due to the one-way clutch 135. However, the second winding roller 120 is not rotated by the second winding gear 143 due to the one-way clutch 145 even when the second winding gear 143 rotates.

When the plurality of roller gears 81 rotate, the first roller 30 coaxially disposed in each of the plurality of roller gears 81 rotates. When the plurality of first rollers 30 rotate, the dust collecting belt 20' is moved by the frictional force between the plurality of first rollers 30 and the dust collecting belt 20'.

In addition, when the first and second regulating gears 151 and 161 rotate, the first and second regulating rollers 150 and 160 rotate integrally. When the first regulating roller 150 rotates, the dust collecting belt 20' being released from the first winding roller 110 is moved toward the plurality of first rollers 30 by the first regulating roller 150. When the second regulating roller 160 rotates, the dust collecting belt 20' is moved to the second winding roller 120 and wound around the second winding roller 120. At this time, because the second winding roller 120 rotates freely regardless of the rotation of the second winding gear 143, the dust collecting belt 20' being conveyed by the second regulating roller 160 is wound around the second winding roller 120. Thus, the dust collecting belt 20' being wound around the second winding roller 120 does not affect the conveying speed of the dust collecting belt 20' being conveyed by the plurality of first rollers 30.

When the dust collecting belt 20' moves to the second winding roller 120, a portion of the dust collecting belt 20' to which contaminants are attached passes through the belt cleaning part 60. When the dust collecting belt 20' passes through the belt cleaning part 60, the first cleaning member 61 of the belt cleaning part 60 removes the contaminants attached to one surface of the dust collecting belt 20', and the second cleaning member 62 removes the contaminants attached to the opposite surface of the dust collecting belt 20'.

When the entire portion of the dust collecting belt 20' wound around the first winding roller 110 is released and the dust collecting belt 20' is wound around the second winding roller 120, the entire portion of the dust collecting belt 20' to which the contaminants are attached passes through the belt cleaning part 60, and thereby the contaminants attached to both surfaces of the dust collecting belt 20' are removed. Therefore, the dust collecting belt 20' may restore the original dust collecting performance.

The belt type electric dust collection devices 10 and 100 according to an embodiment of the disclosure having the structure as described above may automatically remove the contaminants attached to the dust collecting belt 20 and 20'. Therefore, the belt type electric dust collection device 10 and 100 may maintain the air cleaning capability almost permanently even if the user does not periodically clean the electric dust collection devices 10 and 100.

Figure 19:
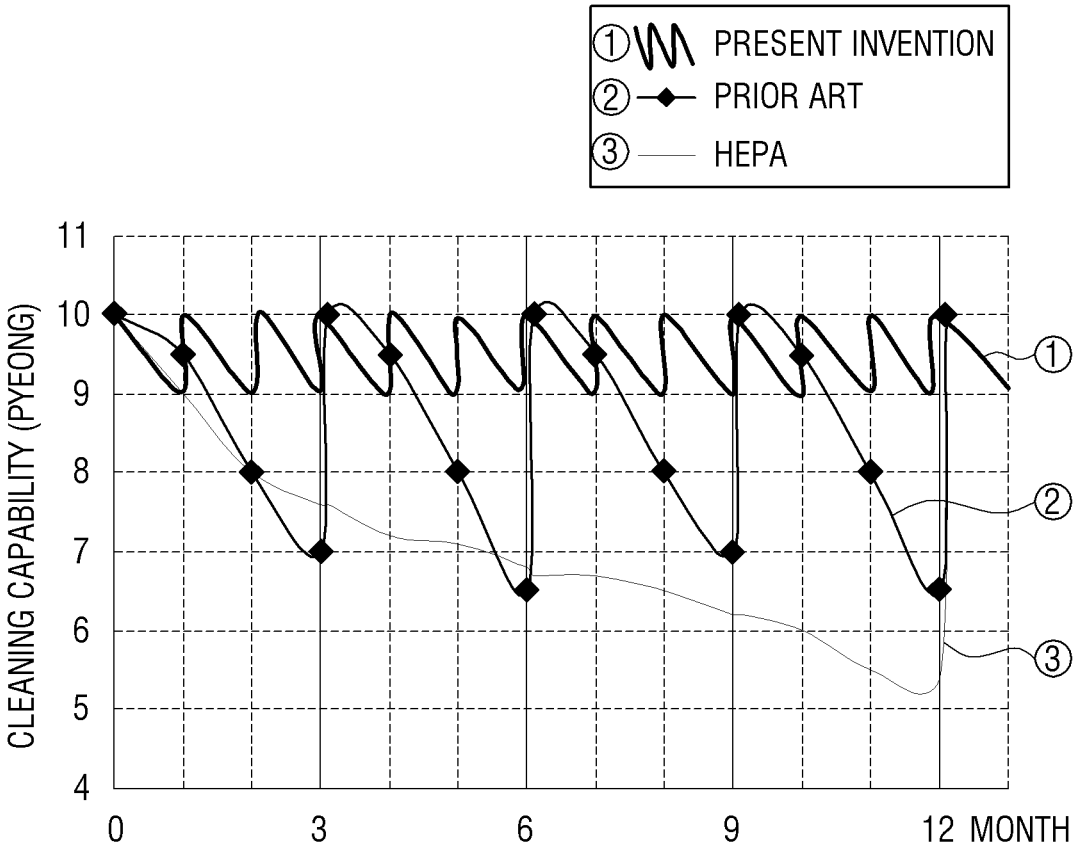
FIG. 19 is a graph for comparing air cleaning capabilities of a belt type electric dust collection device according to an embodiment of the disclosure and a conventional electric dust collection device.

FIG. 19 is a graph for comparing air cleaning capabilities of a belt type electric dust collection device according to an embodiment of the disclosure and a conventional electric dust collection device. For reference, FIG. 19 shows the result of measuring the change of the cleaning capability over time of the belt type electric dust collection device according to an embodiment of the disclosure, a conventional electric dust collection device, and a dust collection device including a HEPA filter (high efficiency particulate air filter) having a capability to clean air of the indoor having an area of 10 pyeong.

In FIG. 19, the line ① represents a change in the air cleaning capability of the belt type electric dust collection device according to an embodiment of the disclosure, the line ② represents a change in the air cleaning capability of the conventional electric dust collection device, and the line ③ represents a change in the air cleaning capability of the dust collection device including the HEPA filter.

Referring to the line ① in FIG. 19, it can be seen that the belt type electric dust collection device according to an embodiment of the disclosure automatically cleans the dust collecting belt once a month to restore the cleaning capability to its original state. However, referring to the line ② in FIG. 19, it can be seen that the conventional electric dust collection device is cleaned manually by the user every three months so that the cleaning capability thereof is restored to its original state. Referring to the line ③ in FIG. 19, it can be seen that in the case of the dust collection device having the HEPA filter, the air cleaning capability decreases continuously with time. In this case, when the HEPA filter is replaced with a new one, the air cleaning capability may be restored to its original state.

The belt type electric dust collection device 10 and 100 according to an embodiment of the disclosure as described above may be provided in an air conditioner.

Figure 20:
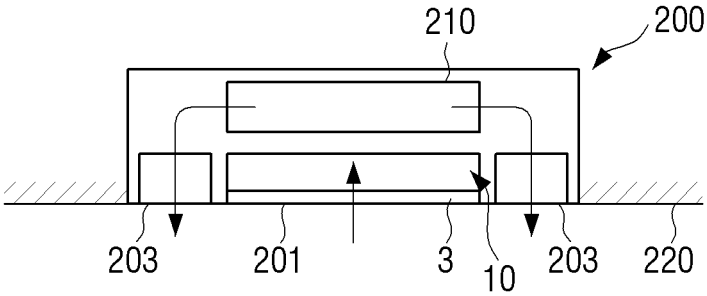
FIG. 20 is a view conceptually illustrating a ceiling type air conditioner provided with a belt type electric dust collection device according to an embodiment of the disclosure.

FIG. 20 is a view schematically illustrating an air conditioner provided with a belt type electric dust collection device according to an embodiment of the disclosure.

FIG. 20 illustrates a case in which a belt type electric dust collection device according to an embodiment of the disclosure is provided in a ceiling type air conditioner.

Referring to FIG. 20, a charging part 3 and a belt type electric dust collection device 10 according to an embodiment of the disclosure are disposed in a stack in an inlet 201 through which indoor air is introduced into the ceiling type air conditioner disposed on the ceiling 220.

An air treatment part 210 configured to suck indoor air and heat or cool the indoor air is provided above the belt type electric dust collection device 10.

Therefore, while the indoor air introduced through the inlet 201 passes through the charging part 3 and the belt type electric dust collection device 10 according to an embodiment of the disclosure, contaminants are removed.

Air from which the contaminants are removed is heated or cooled while passing through the air treatment part 210.

The clean air processed by the air treatment part 210 is discharged back into the indoor through an outlet 203.

Because the belt type electric dust collection device 10 according to an embodiment of the disclosure as described above may automatically remove the contaminants attached to the dust collecting belt 20, there is no need to disassemble the ceiling type air conditioner 200 for cleaning. Therefore, the ceiling type air conditioner 200 using the belt type electric dust collection device 10 according to an embodiment of the disclosure has an advantage of easy maintenance.

In the above description, the belt type electric dust collection device 10 according to an embodiment of the disclosure is applied to the ceiling type air conditioner 200. However, the field of application of the belt type electric dust collection device according to the disclosure is not limited thereto.

The belt type electric dust collection device 10 according to an embodiment of the disclosure may be applied to a variety of air conditioners, for example, a stand type air conditioner, a window type air conditioner, a system air conditioner, a dehumidifier, a humidifier, an air purifier, etc.

In the above description, the disclosure has been described by way of example. The terminology used herein is for the purpose of description and should not be regarded as limiting. Many modifications and variations of the disclosure are possible in light of the above teachings. Accordingly, unless otherwise stated, the disclosure may be practiced freely within the scope of the claims.

The invention claimed is:

1. A belt type electric dust collection device comprising:

a dust collecting belt arranged to be overlapped in a zigzag form, the dust collecting belt including a plurality of flat portions facing each other in parallel and spaced apart by a predetermined distance and a plurality of first bent portions and a plurality of second bent portions formed at both ends of the plurality of flat portions;

a plurality of first rollers disposed in a line in the plurality of first bent portions of the dust collecting belt, the plurality of first rollers configured to support and guide the dust collecting belt;

a plurality of second rollers disposed in a line in the plurality of second bent portions of the dust collecting belt, the plurality of second rollers configured to support and guide the dust collecting belt, some of the plurality of second rollers formed of a conductive material to allow electricity to flow to the dust collecting belt;

a plurality of electrode plates provided between the plurality of flat portions of the dust collecting belt;

a belt cleaning part disposed at one side of the dust collecting belt and configured to remove contaminants attached to both surfaces of the dust collecting belt; and a drive part provided to drive at least two first rollers among the plurality of first rollers so as to move the dust collecting belt, wherein the drive part comprises:

a plurality of roller gears disposed in the at least two first rollers, a worm gear meshing with the plurality of roller gears, and a drive motor configured to rotate the worm gear.

2. The belt type electric dust collection device as claimed in claim 1, wherein the dust collecting belt is formed of one endless belt whose both ends are connected.

3. The belt type electric dust collection device as claimed in claim 1, wherein the drive part further comprises:

a pinion gear disposed on a shaft of the drive motor; and a spur gear disposed coaxially with the worm gear and engaged with the pinion gear.

4. The belt type electric dust collection device as claimed in claim 1, further comprising:

at least one backup roller disposed at one side of the at least two first rollers provided with the plurality of roller gears and configured to press the dust collecting belt against the at least two first rollers.

5. The belt type electric dust collection device as claimed in claim 4, wherein a number of the at least one backup roller is smaller than a number of the at least two first rollers provided with the plurality of roller gears.

6. The belt type electric dust collection device as claimed in claim 1, wherein the plurality of roller gears are disposed in one for every other first roller in the plurality of first rollers.

7. The belt type electric dust collection device as claimed in claim 2, wherein the belt cleaning part is disposed at one side of the plurality of first rollers in a longitudinal direction of the dust collecting belt, and wherein the belt type electric dust collection device further comprises a plurality of guide rollers configured to guide the dust collecting belt to the belt cleaning part.

8. The belt type electric dust collection device as claimed in claim 1, further comprising:

a first winding roller and a second winding roller disposed at both ends of the dust collecting belt and configured to wind and unwind the dust collecting belt.

9. The belt type electric dust collection device as claimed in claim 8, wherein the drive part comprises a roller gear coaxially disposed in at least one of the plurality of first rollers;

a first winding gear train and a second winding gear train configured to respectively transmit a rotational force to the first winding roller and the second winding roller;

a worm gear meshing with the roller gear, the first winding gear train, and the second winding gear train; and a drive motor configured to rotate the worm gear.

10. The belt type electric dust collection device as claimed in claim 9, further comprising:

a first regulating roller and a second regulating roller respectively disposed in front of the first winding roller and the second winding roller and configured to be rotated by power from the worm gear.

11. The belt type electric dust collection device as claimed in claim 1, wherein the belt cleaning part comprises a first cleaning member configured to remove contaminants attached to one surface of the dust collecting belt;

a second cleaning member configured to remove contaminants attached to an opposite surface of the dust collecting belt; and a contaminants container configured to collect the contaminants removed from the dust collecting belt by the first cleaning member and the second cleaning member.

12. The belt type electric dust collection device as claimed in claim 11, wherein the first cleaning member and the second cleaning member are disposed to face each other with the dust collecting belt interposing therebetween.

13. The belt type electric dust collection device as claimed in claim 11, wherein the first cleaning member and the second cleaning member are spaced apart by a predetermined distance in a traveling direction of the dust collecting belt, and wherein the belt cleaning part comprises a first support part configured to support an opposite surface of a portion of the dust collecting belt in contact with the first cleaning member and a second support part configured to support an opposite surface of another portion of the dust collecting belt in contact with the second cleaning member.

14. An air conditioner comprising:

a belt type electric dust collection device of claim 1.

* * * * *